US006336010B1

(12) United States Patent
Kuwabara

(10) Patent No.: US 6,336,010 B1
(45) Date of Patent: Jan. 1, 2002

(54) METHOD AND APPARATUS FOR IMAGE FORMING CAPABLE OF APPROPRIATELY CHANGING A FIXING TEMPERATURE

(75) Inventor: Yoshihiro Kuwabara, Sendai (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/609,055

(22) Filed: Jun. 30, 2000

(30) Foreign Application Priority Data

| | | |
|---|---|---|
| Jul. 1, 1999 | (JP) | 11-187748 |
| Sep. 14, 1999 | (JP) | 11-260935 |
| May 31, 2000 | (JP) | 12-163315 |

(51) Int. Cl.[7] ..... G03G 15/20
(52) U.S. Cl. ..... 399/68; 399/69; 399/400
(58) Field of Search ..... 399/45, 67, 68, 399/69, 82, 85, 381, 400, 396; 347/156

(56) References Cited

U.S. PATENT DOCUMENTS

| | | | | |
|---|---|---|---|---|
| 4,931,842 A | * | 6/1990 | Mahoney | 399/400 X |
| 5,239,348 A | * | 8/1993 | Fukuchi et al. | 399/45 |
| 5,557,385 A | * | 9/1996 | Tanaka et al. | 399/69 |
| 5,768,655 A | * | 6/1998 | Yoshino et al. | 399/69 |
| 5,899,598 A | * | 5/1999 | Yamauchi | 399/67 |
| 6,148,163 A | * | 11/2000 | Ito | 399/67 |

FOREIGN PATENT DOCUMENTS

| | | |
|---|---|---|
| JP | 6-202423 | 7/1994 |
| JP | 8-314301 | 11/1996 |
| JP | 9-325540 | 12/1997 |

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus includes a fixing mechanism, a power source, a sheet transfer mechanism, and a controller. The fixing mechanism includes a heater, and fixes a toner image on a recording sheet at a fixing position. The power source drives the heater. The sheet transfer mechanism transfers the recording sheet from a sheet cassette to an eject tray via the fixing position. The controller changes a sheet transfer speed upon varying an image resolution, instructs the power source to drive the heater to increase a temperature of the heater up to a goal temperature. Further, the controller sets the goal temperature to a predetermined degree when the sheet transfer speed is greater than a predetermined speed, and controls the temperature of the heater via the power source by varying the goal temperature in accordance with values of the sheet transfer speed when the sheet transfer speed is smaller than the predetermined speed.

21 Claims, 18 Drawing Sheets

METHOD AND APPARATUS FOR IMAGE FORMING CAPABLE OF APPROPRIATELY CHANGING A FIXING TEMPERATURE

CROSS-REFERENCE TO RELATED APPLICATIONS

This application claims priority to Japanese patent application Nos. JPAP11-260935 filed on Sep. 14, 1999, JPAP11-187748 filed on Jul. 1, 1999, and JPAP2000-163315 filed on May 31, 2000, the entire contents of which are hereby incorporated by reference.

BACKGROUND

1. Field

The present invention relates to a method and apparatus for image forming, and more particularly to a method and apparatus for image forming that is capable of changing a fixing temperature in accordance with variations of a speed at which a recording sheet is transferred.

2. Description of the Related Arts

A high image resolution has recently been an important feature for image forming apparatuses such as printers, copying machines, facsimile machines. Various kinds of improvements have accordingly been made on an optical writing system of such an image forming apparatus. An image forming apparatus capable of forming an image with different image resolutions at a sheet transfer speed exists but has problems of a complex controlling feature and, accordingly, a relatively high manufacturing cost. In order to avoid these problems, some image forming apparatuses change a sheet transfer speed in accordance with the variations of the image resolution. For example, the sheet transfer speed is reduced in half when the image resolution is doubled.

In addition, many of the above-mentioned image forming apparatuses use a heat roller and a pressure roller for the image fixing operation in which a toner image is heated and fixed with a pressure on a recording sheet such as a paper sheet, an OHP (overhead projector) sheet, and the like. During the image fixing operation, a heating value of the heat roller per unit time is controlled so that the heat roller maintains a predetermined fixing temperature. Thereby, the heat roller can give an appropriate amount of heat to a recording sheet at a nip position formed between the heat pressure rollers. When an excess amount of the fixing heat is given to the toner image, toner particles may be melt which may cause a spot-off phenomenon in which a weak black spot appears in a black area and which may also generate wrinkles. When a less amount of the fixing heat is given to the toner image, the fixing operation may be defective.

As described above, in an image forming apparatus in which a change of the image resolution is achieved by changing the sheet transfer speed, an amount of the fixing heat is varied in accordance with the changed sheet transfer speed and, therefore, the spot-off and wrinkles may be generated. To avoid these problems, it may be effective to set a higher goal value to which the fixing temperature is increased when a faster sheet transfer speed is applied (i.e., a lower image resolution) and to set a lower goal value when a slower sheet transfer speed is applied (i.e., a higher image resolution) so as to continuously provide an appropriate heat to the fixing operation.

However, by the above-mentioned way of avoiding the problems, the variations of the sheet transfer speed simply causes a problem of a bad production or a problem in which predefined controls of the fixing operations, particularly for a multi-resolution type image forming apparatus, is damaged. In addition, if the goal value of the fixing temperature is changed in an image forming apparatus, the fixing operation may be completed when the heat roller is heated up to the temperature of the goal value. In this case, the fixing operation is performed with an improper fixing temperature and causes a production in a bad print quality.

SUMMARY

The present invention provides a novel image forming apparatus. In one example, a novel image forming apparatus includes a fixing mechanism, a power source, a sheet transfer mechanism, and a controller. The fixing mechanism includes a heater, and fixes a toner image on a recording sheet at a fixing position. The power source drives the heater. The sheet transfer mechanism transfers the recording sheet from a sheet cassette to an eject tray via the fixing position. The controller changes a sheet transfer speed upon varying an image resolution, instructs the power source to drive the heater to increase a temperature of the heater up to a goal temperature. Further, the controller sets the goal temperature to a predetermined degree when the sheet transfer speed is greater than a predetermined speed, and controls the temperature of the heater via the power source by varying the goal temperature in accordance with values of the sheet transfer speed when the sheet transfer speed is smaller than the predetermined speed.

The controller may change the goal temperature to one of at least three different values.

The controller may set the goal temperature to a first temperature when the sheet transfer mechanism transfers the recording sheet at a first speed and to a second temperature when the sheet transfer mechanism transfers the recording sheet at a second speed. In this case, the first temperature is higher than the second temperature and the first speed is faster than the second speed. Further, the controller instructs the sheet transfer mechanism to start a sheet transfer operation when a temperature of the heater reaches the goal temperature changed in accordance with the sheet transfer speed when the controller changes the sheet transfer speed.

The sheet transfer mechanism may include a registration member for holding and registering the recording sheet before entering into the fixing position.

The controller may instruct the sheet transfer mechanism to start a sheet transfer operation at a time so that a recording sheet arrives at the fixing position when a temperature of the heater reaches the goal temperature which is changed in accordance with the sheet transfer speed when the controller changes the sheet transfer speed.

The image forming apparatus may further include a mode selection mechanism for selecting one of first and second modes. In the first mode, the controller instructs the sheet transfer mechanism to start a sheet transfer operation after a temperature of the heater reaches the goal temperature which is changed in accordance with the sheet transfer speed when the controller changes the sheet transfer speed. In the second mode, the controller instructs the sheet transfer mechanism to start a sheet transfer operation before a temperature of the heater reaches the goal temperature which is changed in accordance with the sheet transfer speed when the controller changes the sheet transfer speed.

In the first mode, the controller may instruct the sheet transfer mechanism to start the sheet transfer operation at a time so that the recording sheet arrives at the fixing position when the temperature of the heater reaches the goal temperature. Further, in the second mode, the controller may instruct the sheet transfer mechanism to start the sheet transfer operation at a time so that the recording sheet arrives at the fixing position before the temperature of the heater reaches the goal temperature.

The mode selection mechanism may select one of the first and second modes when the sheet transfer speed is changed from the first speed to the second speed.

The mode selection mechanism may independently select one of the first and second modes when the sheet transfer speed is changed from the first speed to the second speed and when the sheet transfer speed is changed from the second speed to the first speed.

The mode selection mechanism may select one of the first and second modes based on a command sent from an external host system connected to the apparatus.

The apparatus may handle thick and thin recording sheets and the mode selection mechanism may select the first mode for the thin recording sheet.

Further, the present invention provides a method for image forming which includes the steps of changing, setting, controlling, increasing, and fixing. The changing step changes a sheet transfer speed for transferring a recording sheet upon varying an image resolution. The setting step sets a goal temperature to a predetermined degree in accordance with values of the sheet transfer speed when the sheet transfer speed is greater than a predetermined value. The controlling steps controls a temperature of a heater when the sheet transfer speed is smaller than the predetermined speed. The increasing step increases the temperature of the heater up to the goal temperature. The fixing step fixes a toner image deposited on the recording sheet at the goal temperature.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION

Figure 1:
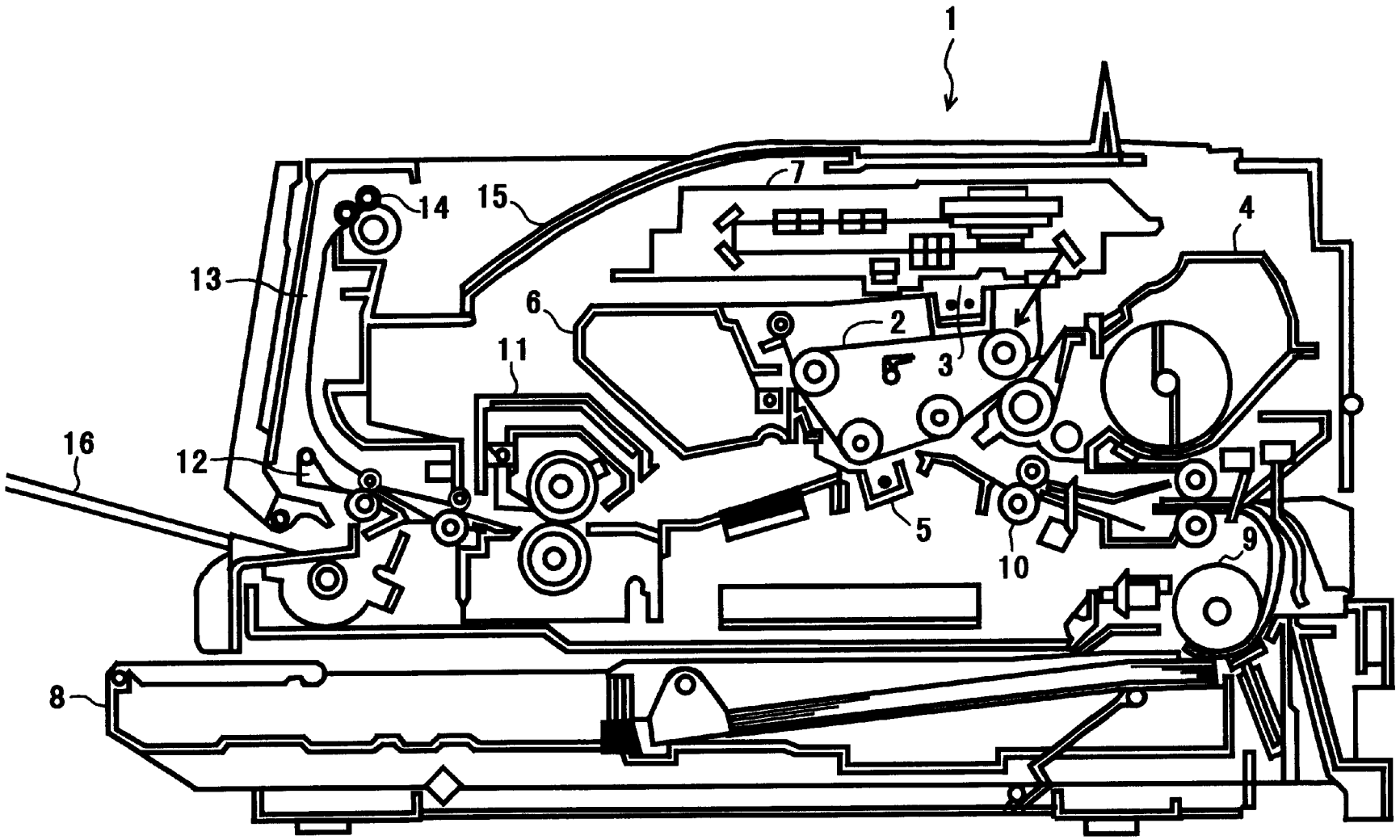
FIG. 1 is a side sectional view of a laser printer according to an embodiment of the present invention.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Referring now to the drawings, wherein like reference numerals designate identical or corresponding parts throughout the several views, particularly to FIG. 1, there is illustrated a laser printer 1. As illustrated in FIG. 1, the laser printer 1 includes a belt-shaped photoconductive member 2 approximately in the center thereof. The laser printer 1 further includes a main charger 3, a development unit 4, a transfer charger 5, and a cleaning unit 6, arranged around the periphery of the photoconductive member 2 in the clockwise direction in the drawing. The laser printer 1 further includes an optical writing unit 7 arranged above the photoconductive member 2 and a sheet supply cassette 8 at the bottom of the laser printer 1. The sheet supply cassette 8 contains a relatively larger number of recording sheets, and is detachably installed in the laser printer 1.

The photoconductive member 2 is driven for rotation in the clockwise direction in the drawing. During the rotation, the surface of the photoconductive member 2 is evenly charged by the main charger 3. An electrostatic latent image is written on this charged surface of the photoconductive member 2 by the action of a laser beam generated from the optical writing unit 7. The latent image is visualized by deposition of toner when it passes by a developing position where the development unit 4 is positioned.

A recording sheet is picked up from the sheet supply cassette 8 by a pick-up roller 9 and is fed to the bottom side of the photoconductive member 2 in synchronism with an operation of registration rollers 10. The toner image carried by the photoconductive member 2 is transferred to the upper surface of the recording sheet by the transfer charger 5. After the transfer, the photoconductive member 2 is cleaned by the cleaning unit 6 and the toner remaining on the photoconductive member 2 is removed.

The recording sheet having the toner image is fed to a fixing unit 11 which fixes the toner image on the recording sheet. After the fixing unit 11, the recording sheet is transferred through a face-down path 13 by a switch solenoid pawl 12 for switching between face-down and face-up orientations. Then, the recording sheet is ejected to a face-down eject tray 15 in the face-down orientation by face-down eject rollers 14. Alternatively, the recording sheet may be ejected to a face-up eject tray 16 in the face-up orientation by the action of the switching solenoid pawl 12.

Figure 2:
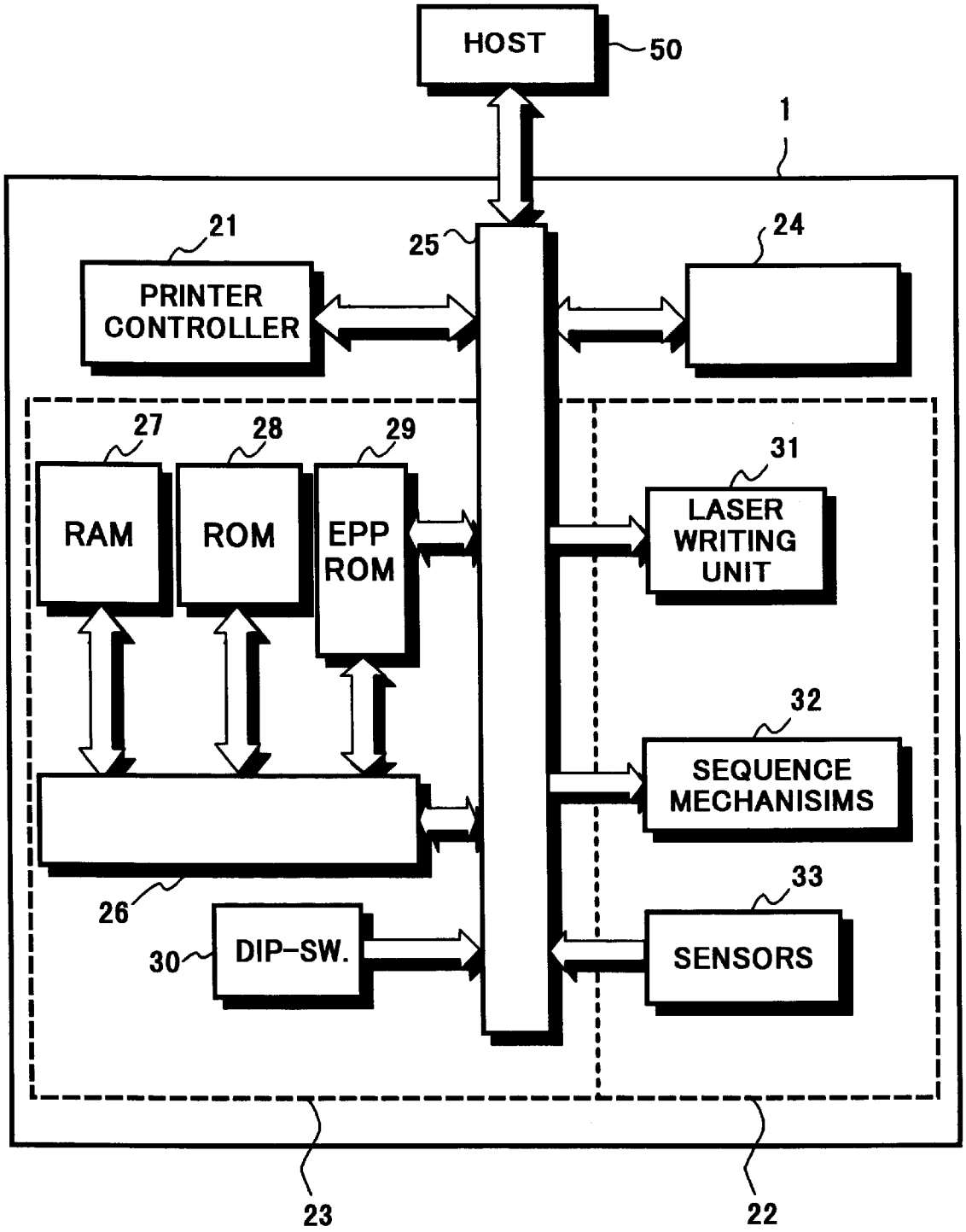
FIG. 2 is a block diagram of the laser printer of FIG. 1.

Referring to FIG. 2, a control system of the laser printer 1 is explained. As illustrated in FIG. 2, the laser printer 1 includes a printer controller 21 for performing an image processing operation, a print engine 22 for forming an image, an engine control board 23 for controlling the print engine 22, and an operation panel 24. The laser printer 1 is connected to an external host system 50 (i.e., a computer) via an input-and-output interface 25 of the engine control board 23 and communicates with the external host system 50.

The engine control board 23 includes a CPU (central processing unit) 26, a RAM (random access memory) 27, a ROM (read only memory) 28, an EEPROM (electrically erasable programmable ROM) 29, and a DIP switch 30. The CPU 26 controls the entire operations of the print engine 22 with the helps of programs stored in the ROM 28, mode instructions from the operation panel 24, commands from the printer controller 21. The RAM 27 serves as a working memory for the CPU 26 and also as an input buffer for input data. The ROM 28 stores various control programs. The EEPROM 29 is a nonvolatile memory and stores various kinds of information including an error history of the print engine 22, the contents of the mode instruction sent from the operation panel 24, and so on. The DIP switch 30 switches the modes of the engine control.

The print engine 22 includes a laser writing unit 31, sequence mechanisms 32, and a set of sensors 33. The laser writing unit 31 includes an LD (laser diode), a polygon motor, and so on, which are not shown. The sequence mechanisms 32 control the engine sequences of the fixing, developing, and driving systems. The set of sensors 33 includes various sensors for detecting the conditions of the sheet paths, the sequences, and so on.

Figure 3:
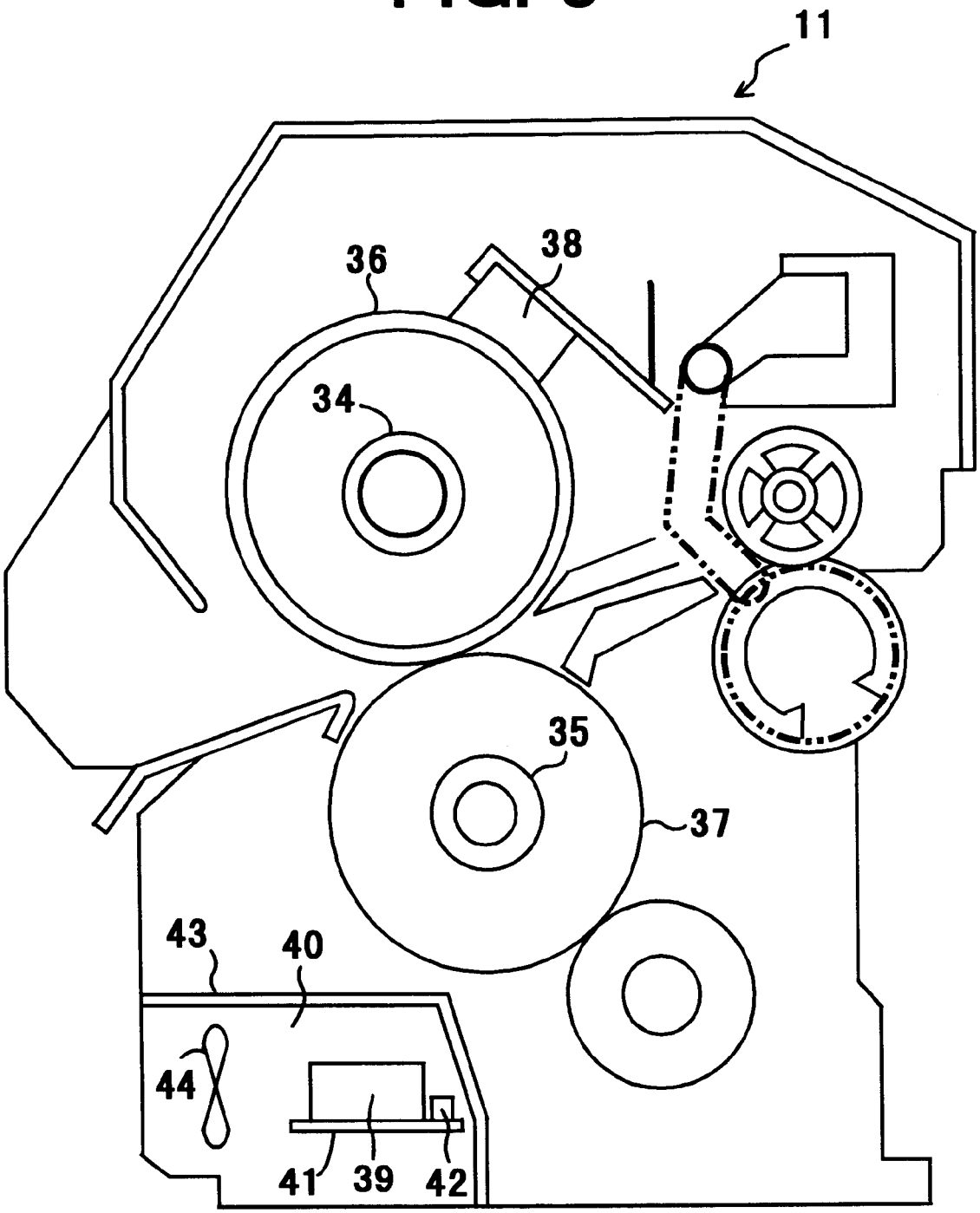
FIG. 3 is an illustration for showing a fixing mechanism of the laser printer of FIG. 1.

Referring to FIG. 3, the fixing unit 11 is explained in detail. As illustrated in FIG. 3, the fixing unit 11 includes an upper fixing roller 36 including a heater 34 and a lower fixing roller 37 including a heater 35. The fixing roller 36 is in contact with a thermistor 38 for detecting the surface temperature of the upper fixing roller 36. This thermistor 38 provides information necessary for controlling the upper and lower fixing units 36 and 37 to have a predetermined fixing temperature.

The fixing unit 11 further includes a memory 39 for storing intrinsic information of the fixing unit 11. The memory 39 includes a volatile memory such as an EEPROM or with a backup battery, and is capable of being read and written. When the fixing unit 11 is installed in the laser printer 1, the memory 39 is connected to the CPU 26 (FIG. 2) so that the CPU 26 can read the intrinsic information of the fixing unit 11 and controls the operations in accordance with the read information. Alternatively, the CPU 26 can load necessary information into the memory 39 of the fixing unit 11 and the CPU operates in accordance with this loaded information. With this configuration, the memory 39 can store the degree of usage, for example, and the CPU 26 can determine whether the fixing unit is still in its lifetime by reading the information of the memory 39.

The memory 39 and a thermistor 42 are mounted on a printed circuit board 41 which is installed in a heat insulation chamber 40 separated by a heat insulation wall 43 such that the memory 39 and the thermistor 42 are not directly subjected to the heat produced by the upper and lower fixing rollers 36 and 37. When the ambient temperature around the printed circuit board 41 exceeds a predetermined temperature, the thermistor 42 detects it and a cooling fan 44 is driven to assure the temperature for the memory 39.

Figure 4:
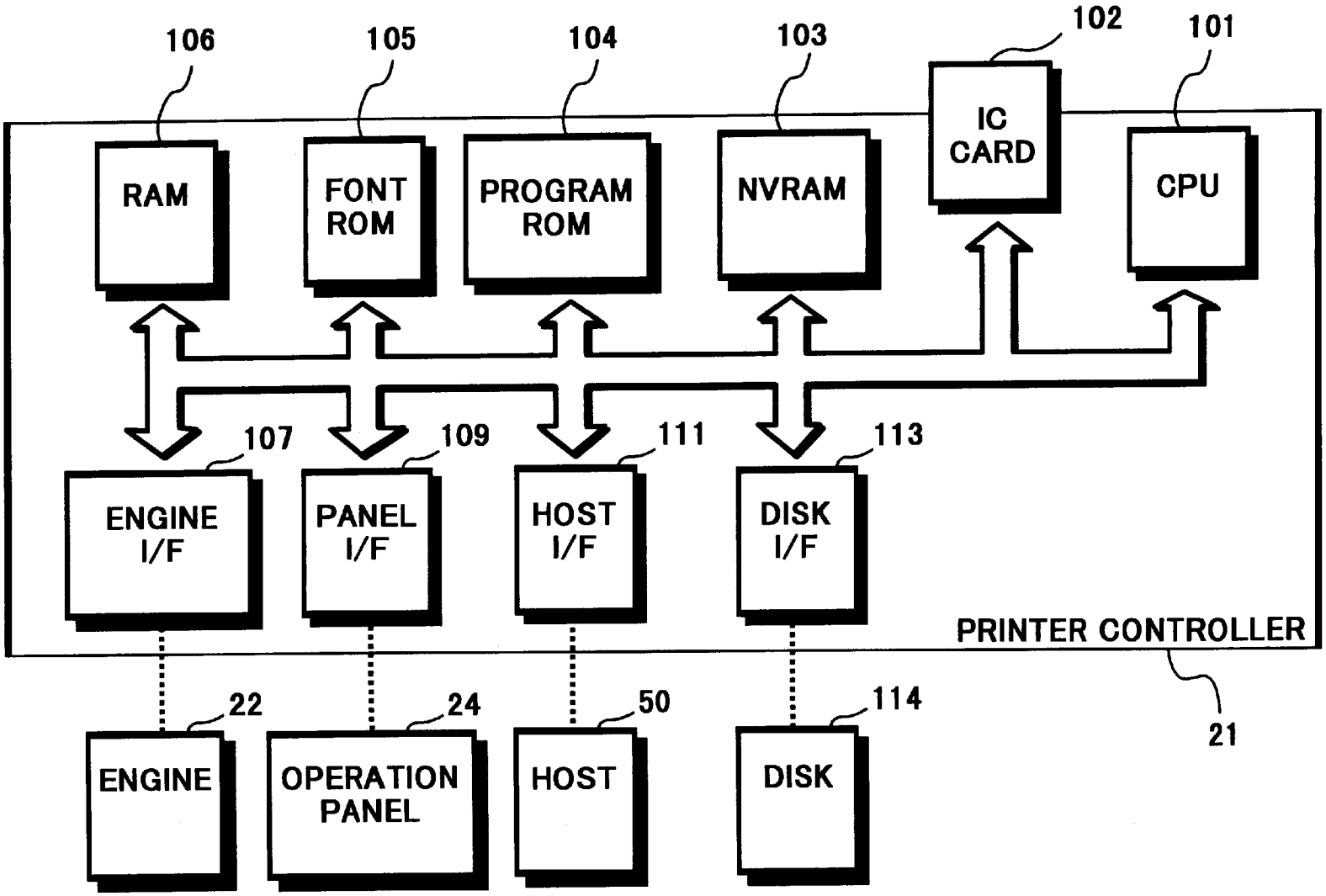
FIG. 4 is a block diagram of a printer controller of the laser printer of FIG. 1.

Referring to FIG. 4, a configuration of the printer controller 21 of the laser printer 1 is explained. As illustrated in FIG. 4, the printer controller 21 includes a CPU 101, a NVRAM (non-volatile RAM) 103, a program ROM 104, a font ROM 105, a RAM 106, an engine I/F (interface) 107, a panel I/F 109, a host I/F 111, and a disk I/F 113. The printer controller 21 has a receptor (not shown) for receiving an IC (integrated circuit) card 102.

The CPU 101 controls the entire operations of the printer controller 21 in accordance with programs previously stored in the program ROM 104, mode instructions sent from the operation panel 24, and commands sent from the external host system 50. The IC card 102 is an external data source for providing font data, programs, and so on. The NVRAM 103 is a non-volatile memory for storing the contents of instructions sent from the operation panel 24. The program ROM 104 stores control programs used by the printer controller 21. The font ROM 105 mainly stores pattern data of each font. The RAM 106 serves as a working memory to be used by the CPU 101, an input buffer for input data, a page buffer for print data, and a memory for downloaded fonts.

The engine I/F 107 interfaces the communications of commands, statuses, and print data with the engine 22. The panel I/F 109 interfaces the communications of commands and statuses with the operation panel 24. The host I/F 111 interfaces the communications with the external host system 50, and is normally in accordance with Centronics specification or RS232C interface. The disk I/F 113 interfaces the communications with a disk drive apparatus 114 which is a floppy or hard disk drive apparatus for storing various kinds of data including font data, programs, print data and so on.

The printer controller 21 receives character information and image information from the external host system 50, analyzes the information, and stores it into RAM 106 as print data in the unit of a recording page. The print data in the unit of a recording unit is output from the engine I/F 107 to the engine 22 so as to be printed on a recording sheet.

Figure 5:
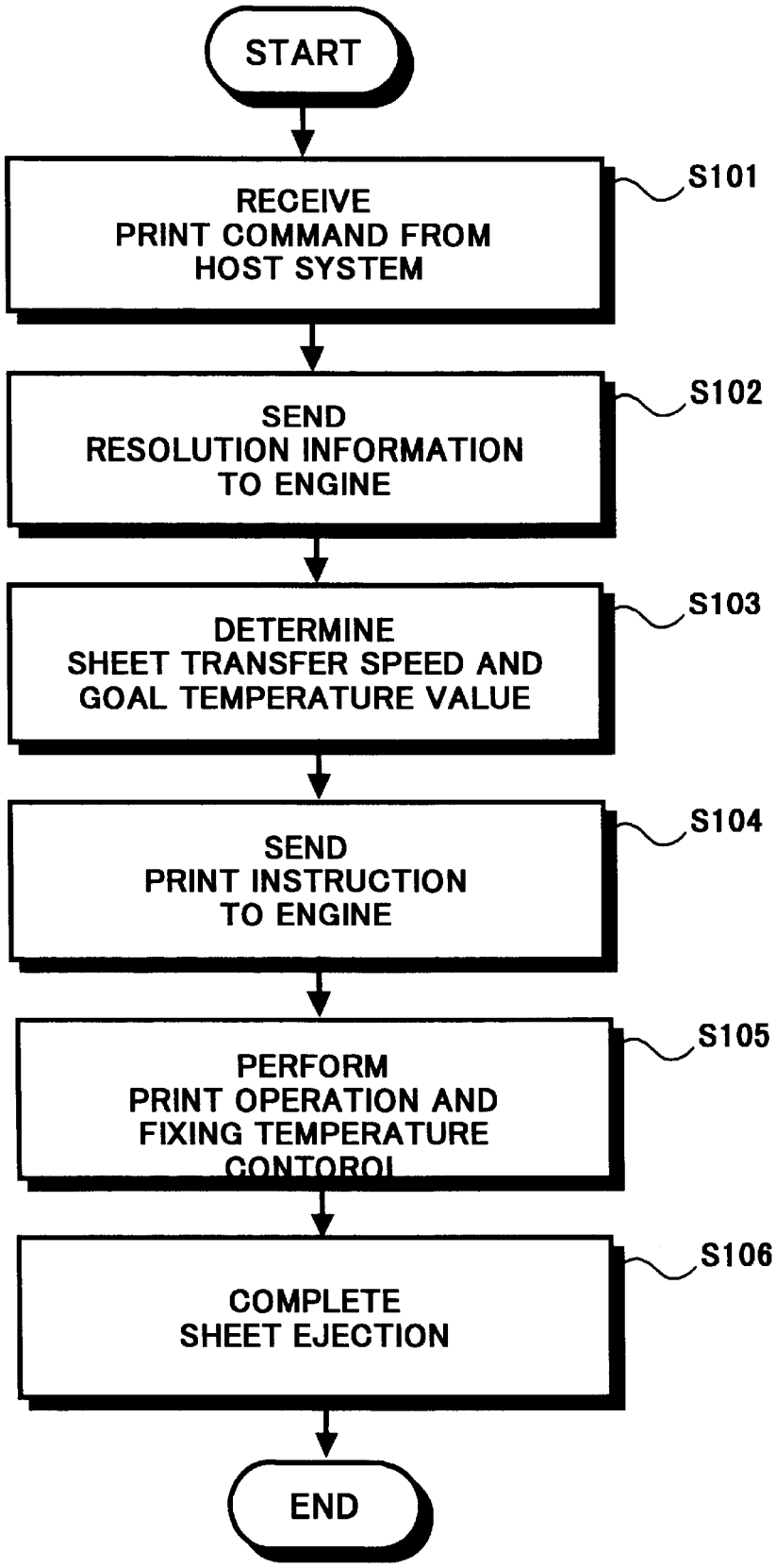
FIG. 5 is a flowchart for explaining a first example of an image forming operation performed by the laser printer of FIG. 1.
Figure 6:
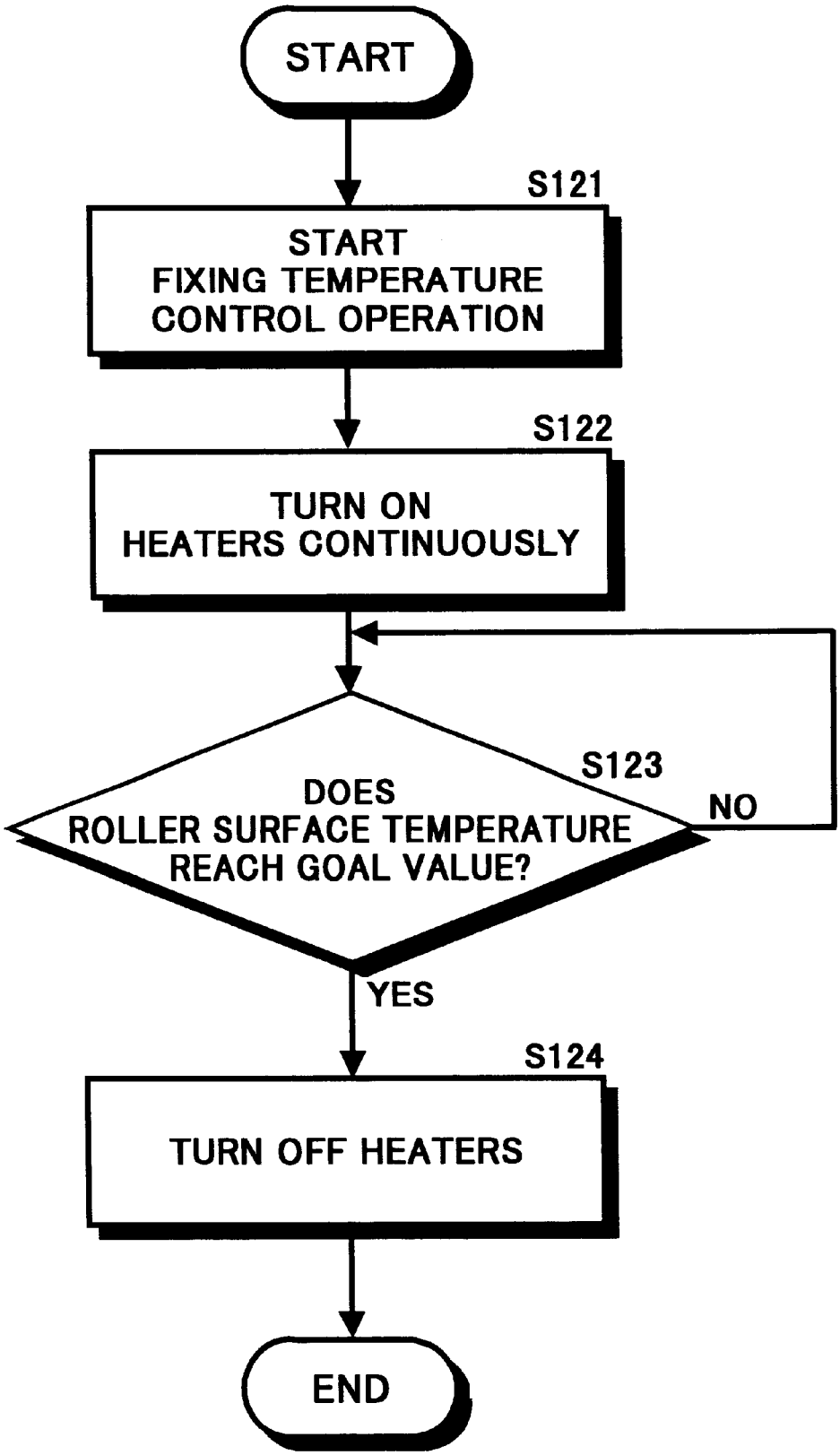
FIG. 6 is a flowchart for explaining a fixing temperature change operation performed in the first example by the laser printer of FIG. 1.

Referring now to FIGS. 5 and 6, a first control procedure for controlling the fixing temperature in accordance with the variations of the speed at which the recording sheet is transferred in the laser printer 1 is explained. In the laser printer 1, a high resolution feature is supported by the variable speeds of transfer of the recording sheet. More specifically, the line speed of 92 mm/s at the 600 dpi is changed to the line speed of 46 mm/s at the 1200 dpi or the line speed of 130 mm/s at the 400 dpi. According to the variations of the sheet transfer speed, the fixing temperature is also changed.

FIG. 5 shows an outline of a print control performed during the above-mentioned first control procedure by the printer controller 21 of the laser printer 1. In Step S101, the printer controller 1 receives a print command from the external host system 50. Upon a receipt of the print command by the laser printer 1, the printer controller 21 provides the CPU 26 of the engine control board 23 with the information of the print resolution requested by the print command in Step S102. In Step S103, the CPU 26 determines a transfer speed of recording sheets and a goal value of the surface temperature of the fixing rollers. In Step S104, the printer controller 21 sends a print instruction to the CPU 26. In this case, the print instruction requests the performance of a print operation including the operations of recording sheet feeding, image forming, image transferring, image fixing, and so on. In Step S105, the CPU 26 instructs the engine 22 to perform the print operation using the transfer speed of recording sheets and the goal value of the surface temperature of the fixing rollers determined by the CPU 26. In Step S106, the CPU 26 instructs the engine 22 to perform the recording sheet ejection operation for ejecting the printed recording sheet to the eject tray, and the process ends.

FIG. 6 shows a fixing control performed during the above-mentioned first control procedure by the CPU 26 and the engine 22. In Step S121, the CPU 26 starts the fixing control. In Step S122, the CPU 26 instructs the engine 22 to continuously turn on the heaters 34 and 35. In Step S123, the CPU 26 checks if the temperature information sent from the thermistor 38 reaches the above-mentioned goal temperature. If the temperature information sent from the thermistor 38 reaches the above-mentioned goal temperature and the check result of Step S123 is YES, the CPU 26 in Step S124 instructs the engine 22 to turn off the heaters 34 and 35, and the process ends.

In this example, the goal surface temperature of the fixing rollers is set to 180° C. at the line speed of 92 mm/s with 600 dpi and the line speed of 130 mm/s with 400 dpi and to 140° C. at the line speed of 46 mm/s with 1200 dpi. That is, this example has two goal values for the surface temperature of the fixing rollers for three different line speed of recording sheets. Alternatively, the goal values for the surface temperature of the fixing rollers may be provided in a larger number of steps in accordance with a larger number of line speed variations. For example, three goal temperatures may be prepared for four variations in the line speed. However, in a case when the image resolution is smaller than a certain value, the goal surface temperature needs to be a certain fixed value by the following reason.

Figure 7:
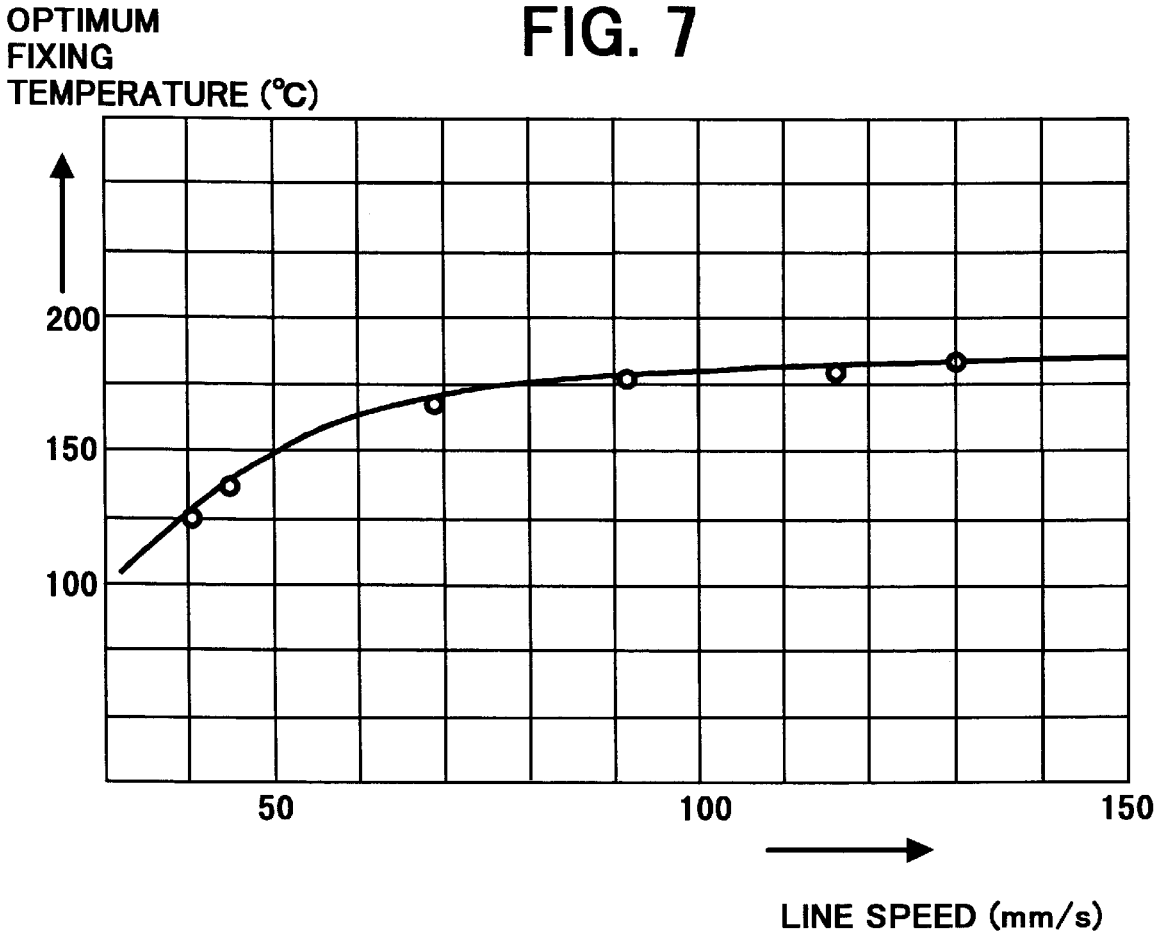
FIG. 7 is a graph for showing a relationship between an optimum fixing temperature and a line speed.

FIG. 7 shows a result of an experiment in which an optimum goal surface temperature causing no defective image fixing was sought by gradually increasing the line speed of recording sheets. As shown in FIG. 7, the optimum goal surface temperature is converged at a fixing value (i.e., 180° C.) when the line speed is greater than a certain value (i.e., 90 mm/s). That is, there is a fixed optimum temperature with which the fixing unit is allowed to sufficiently perform the fixing operation in a case when the line speed is increased over a certain value. If the optimum temperature is increased in accordance with the increase of the line speed, it may causes various problems such as the above-mentioned spot-off phenomenon, a complex control due to the increased number of goal values of the surface temperature, and a reduction of productivity due to an increase of a time period for the user to wait until the temperature reaches its goal, for example.

In one example having four line speeds, the goal temperature value may be set to 120° C. at the line speed of 35 mm/s with 1600 dpi, 140° C. at the line speed of 46 mm/s with 1200 dpi, and 180° C. at the line speed of 92 mm/s with 600 dpi and at the line speed of 130 mm/s with 400 dpi. In this case, the goal temperature value is fixed to 180° C. for the line speed over the 92 mm/s.

In another example, the goal temperature value may be set to 140° C. at the line speed of 35 mm/s with 1200 dpi, and 180° C. at the line speeds of 92, 130, and 150 mm/s with 600, 400, and 200 dpi, respectively.

Figure 16:
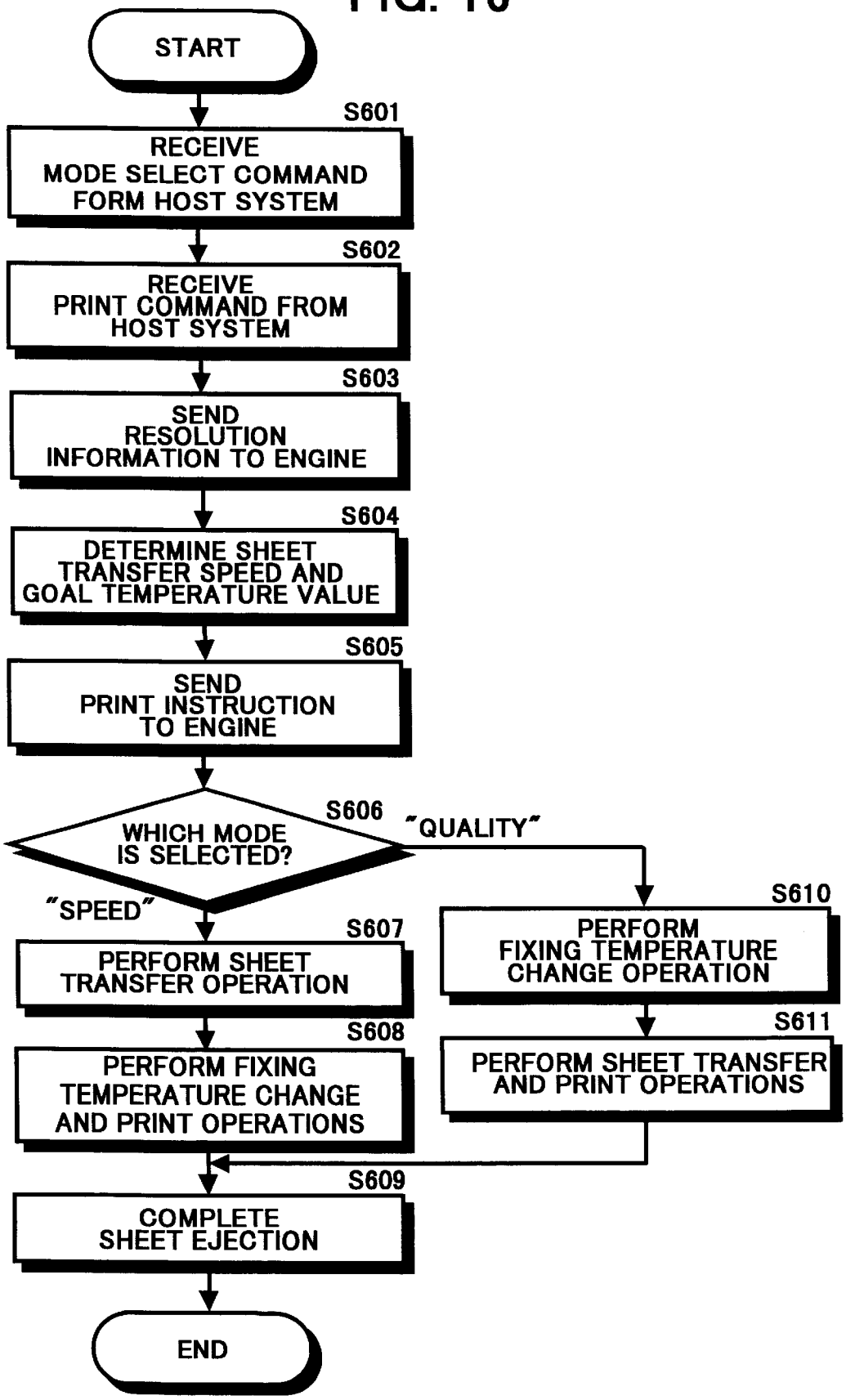
FIG. 16 is a flowchart for explaining a sixth example of an image forming operation performed by the laser printer of FIG. 1.

FIG. 16 shows an example of the variations of the fixing temperature controlled by the conventional image forming machine. In FIG. 16, the vertical axis represents the surface temperature of the fixing rollers. Terms $T_{FL}$, $T_{FH}$, and $T_{FO}$ represent lower and upper limits of the fixing temperature and a goal surface temperature of the fixing rollers, respectively. In the conventional image forming machine, the a goal surface temperature is set to a fixed value between $T_{FL}$ and $T_{FH}$ which means the goal temperature is not variable.

In this way, the laser printer 1 is capable of changing the fixing temperature so as to give an appropriate amount of the fixing heat to the recording sheet. Thereby, the laser printer 1 can avoid occurrence of the spot-off defect and wrinkles on the recording sheet when the fixing rollers gives an excess amount of the fixing heat to the recording sheet and of the defective fixing operation when the fixing rollers gives too small amount of the fixing heat to the recording sheet.

Next, a second control procedure for controlling the fixing temperature in accordance with the variations of the speed at which the recording sheets is transferred in the laser printer 1 is explained with reference to FIGS. 8 and 9. This control is capable of avoiding a problem in which the recording sheet is already subjected to the fixing operation or the ejection operation when the surface temperature of the fixing roller reaches a newly established goal temperature, wherein the fixing operation may not be properly performed.

Figure 8:
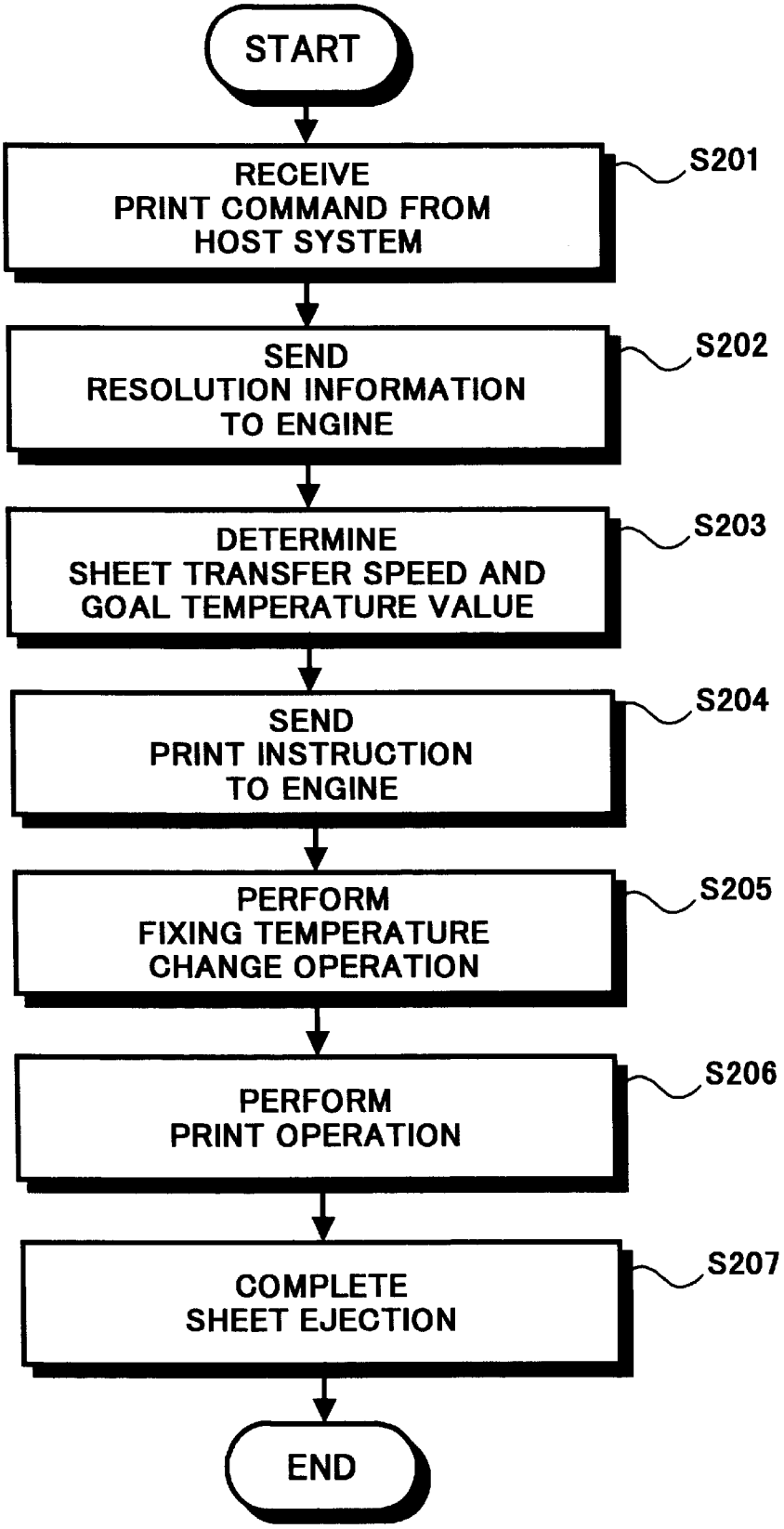
FIG. 8 is a flowchart for explaining a second example of an image forming operation performed by the laser printer of FIG. 1.

FIG. 8 shows an outline of a print control performed during the above-mentioned second control procedure by the printer controller 21 of the laser printer 1. In Step S201, the printer controller 1 receives a print command from the external host system 50. Upon a receipt of the print command by the laser printer 1, the printer controller 21 provides the CPU 26 of the engine control board 23 with the information of the print resolution requested by the print command in Step S202. In Step S203, the CPU 26 determines a transfer speed of the recording sheets and a goal value of the surface temperature of the fixing rollers. In Step S204, the printer controller 21 sends a print instruction to the CPU 26. The print instruction requests the performance of a print operation including the operations of sheet feeding, image forming, image transferring, image fixing, and so on.

In Step S205, the CPU 26 performs a fixing temperature change operation. Then, in Step S206, the CPU 26 instructs the engine 22 to perform the print operation using the transfer speed of the recording sheets and the goal value of the surface temperature of the fixing rollers determined by the CPU 26. In Step S207, the CPU 26 instructs the engine 22 to perform the recording sheet ejection operation for ejecting the printed recording sheet to the eject tray, and the process ends.

Figure 9:
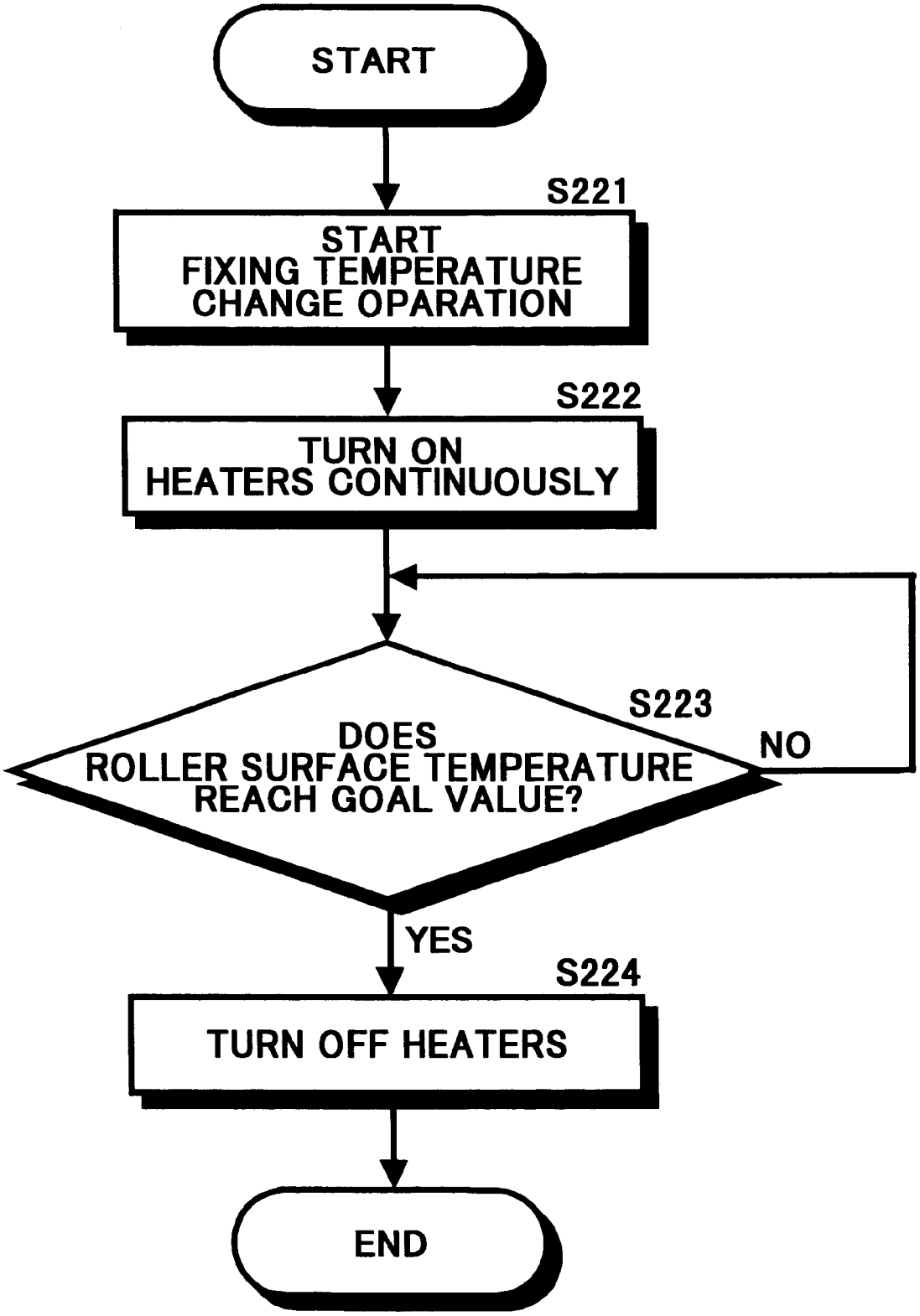
FIG. 9 is a flowchart for explaining a fixing temperature change operation performed in the second example by the laser printer of FIG. 1.

FIG. 9 shows an exemplary procedure of the fixing temperature change operation performed during the above-mentioned second control procedure by the CPU 26 and the engine 22. In Step S221, the CPU 26 starts the fixing temperature change operation. In Step S222, the CPU 26 instructs the engine 22 to continuously turn on the heaters 34 and 35. In Step S223, the CPU 26 checks if the temperature information sent from the thermistor 38 reaches the goal surface temperature. If the temperature information sent from the thermistor 38 reaches the goal surface temperature and the check result of Step S223 is YES, the process proceeds to Step S224 and the CPU 26 instructs the engine 22 to turn off the heaters 34 and 35. Then, the process ends.

In this way, the laser printer 1 can start the print operation after the fixing temperature reaches the goal value when the line speed of recording sheets is changed. Thereby, the laser printer 1 can give an appropriate fixing temperature to the recording sheet so as to properly perform the print operation. Accordingly, the laser printer 1 can avoid the above-mentioned problem in which the recording sheet is already subjected to the fixing operation or the ejection operation when the surface temperature of the fixing roller reaches a newly established goal temperature, wherein the fixing operation may not be properly performed.

Next, a third control procedure for controlling the fixing temperature in accordance with the variations of the speed at which the recording sheet is transferred in the laser printer 1 is explained with reference to FIGS. 10 and 11. This control is capable of avoiding a problem in which a first print takes a relatively long time period, wherein the first print is defined as a first page printed after the print command is processed. The reason for the above problem is that the sheet feeding operation is required to be performed after the surface temperature of the fixing roller reaches a newly established goal temperature. This control makes the first print faster by allowing the sheet feeding operation to start before the fixing temperature reaches the goal value, using a time period needed for the recording sheet to run along the sheet path from the sheet supply cassette 8 to the fixing position.

Figure 10:
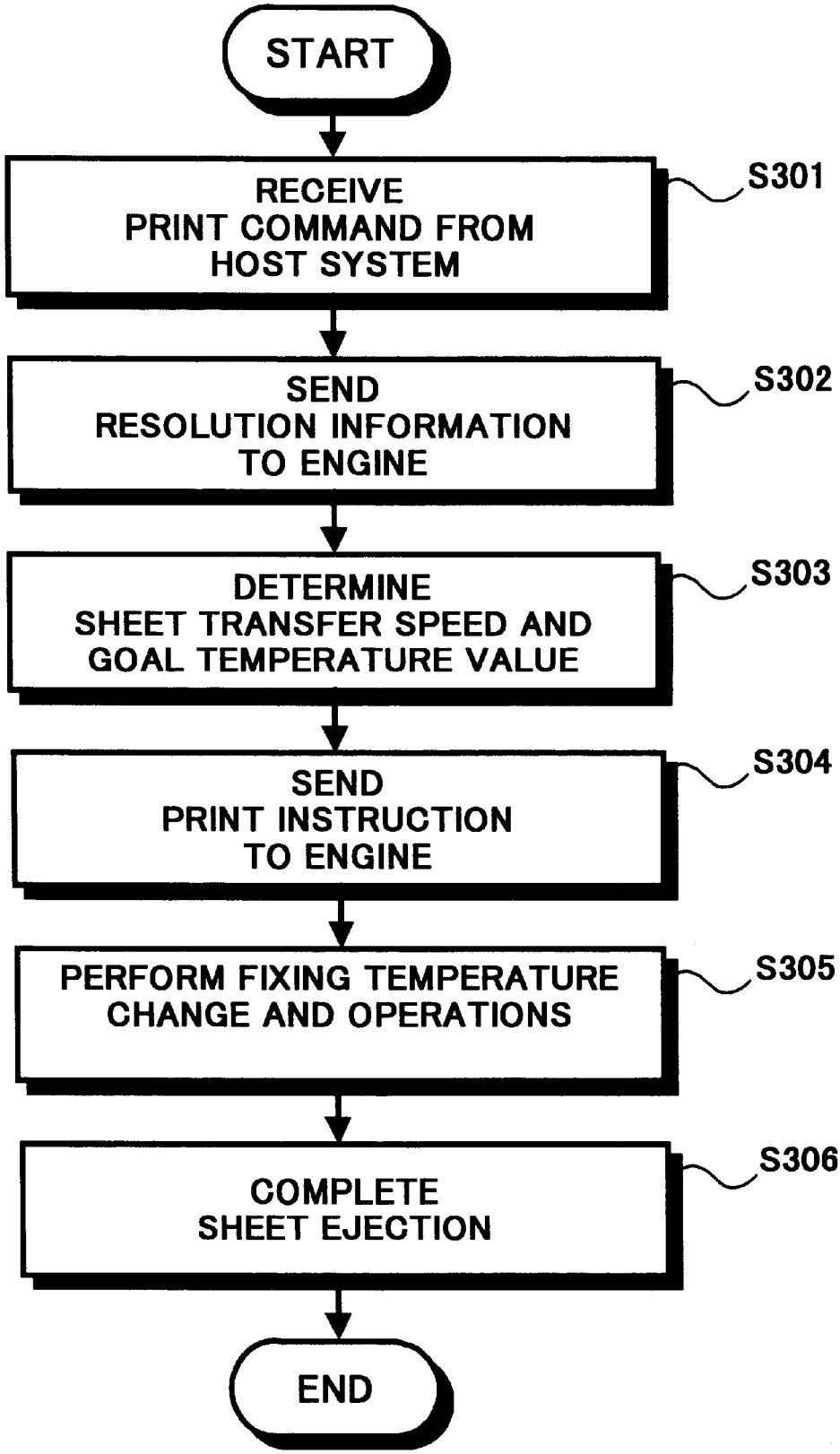
FIG. 10 is a flowchart for explaining a third example of an image forming operation performed by the laser printer of FIG. 1.

FIG. 10 shows an outline of a print control performed during the above-mentioned third control procedure by the printer controller 21 of the laser printer 1. In Step S301, the printer controller 1 receives a print command from the external host system 50. Upon a receipt of the print command by the laser printer 1, the printer controller 21 provides the CPU 26 of the engine control board 23 with the information of the print resolution requested by the print command in Step S302. In Step S303, the CPU 26 determines a transfer speed of recording sheets and a goal value of the surface temperature of the fixing rollers. In Step S304, the printer controller 21 sends a print instruction to the CPU 26. In this case, the print instruction requests the performance of a print operation including the operations of recording sheet feeding, image forming, image transferring, and so on.

In Step S305, the CPU 26 performs a fixing temperature change operation. During this fixing temperature change operation, the CPU 26 instructs the engine 22 to perform the print operation using the transfer speed of recording sheets and the goal value of the surface temperature of the fixing rollers determined by the CPU 26, the details of which is shown in FIG. 11. In Step S306, the CPU 26 instructs the engine 22 to perform the fixing operation and the sheet ejection operation, and the process ends.

Figure 11:
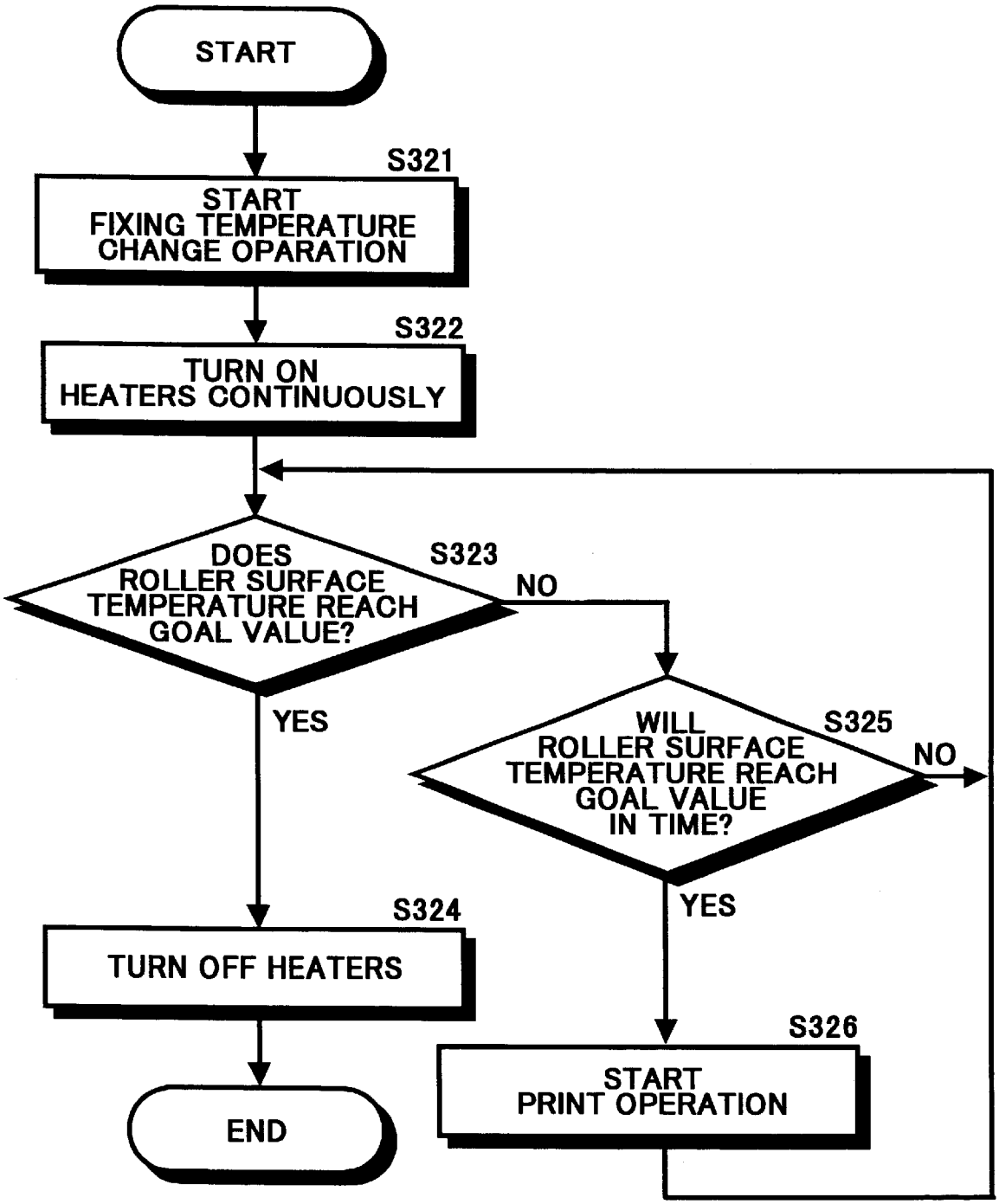
FIG. 11 is a flowchart for explaining a fixing temperature change operation performed in the third example by the laser printer of FIG. 1.

FIG. 11 shows another exemplary procedure of the fixing temperature change operation performed during the above-mentioned third control procedure by the CPU 26 and the engine 22. In Step S321, the CPU 26 starts the fixing temperature change operation. In Step S322, the CPU 26 instructs the engine 22 to continuously turn on the heaters 34 and 35. In Step S323, the CPU 26 checks if the temperature information sent from the thermistor 38 reaches the goal surface temperature. If the temperature information sent from the thermistor 38 reaches the goal surface temperature and the check result of Step S323 is YES, the process proceeds to Step S324 and the CPU 26 instructs the engine 22 to turn off the heaters 34 and 35. Then, the process ends.

If the temperature information sent from the thermistor 38 does not yet reach the goal surface temperature and the check result of Step S323 is NO, the process proceeds to Step S325 in which the CPU 26 determines if the surface temperature of the fixing rollers reaches the goal surface temperature at the time when the recording sheet arrives at the transfer fixing position. If the surface temperature of the fixing rollers does not reach the goal surface temperature at the time when the recording sheet arrives at the transfer fixing position and the determination result of Step S325 is NO, the process returns to Step S323 to repeat the above-mentioned check. If the surface temperature of the fixing rollers reaches the goal surface temperature at the time when the recording sheet arrives at the transfer fixing position and the determination result of Step S325 is YES, the process proceeds to Step S326 and the CPU 26 instructs the engine 22 to perform the sheet transfer operation. After that, the process returns to Step S323 to check if the surface temperature of the fixing roller reaches the goal value.

In this way, the laser printer 1 can takes an account of a time period needed for the recording sheet to run from the sheet supply cassette 8 to the fixing position and can start the recording sheet feeding operation of the print operation before the fixing temperature reaches the goal value when the line speed of recording sheets is changed. Thereby, the laser printer 1 can properly perform the print operation and can produce the first print in a relatively faster manner.

Next, a fourth control procedure for controlling the fixing temperature in accordance with the variations of the speed at which the recording sheet is transferred in the laser printer 1 is explained with reference to FIGS. 12 and 13. This control is capable of avoiding a problem in which a first print takes a relatively long time period. The reason for the above problem is that the sheet feeding operation is required to be performed after the surface temperature of the fixing roller reaches a newly established goal temperature. This control makes the first print faster by allowing the next recording sheet waiting at the registration position and starting the transfer of the recording sheet upon a time when the fixing temperature reaches the goal value.

Figure 12:
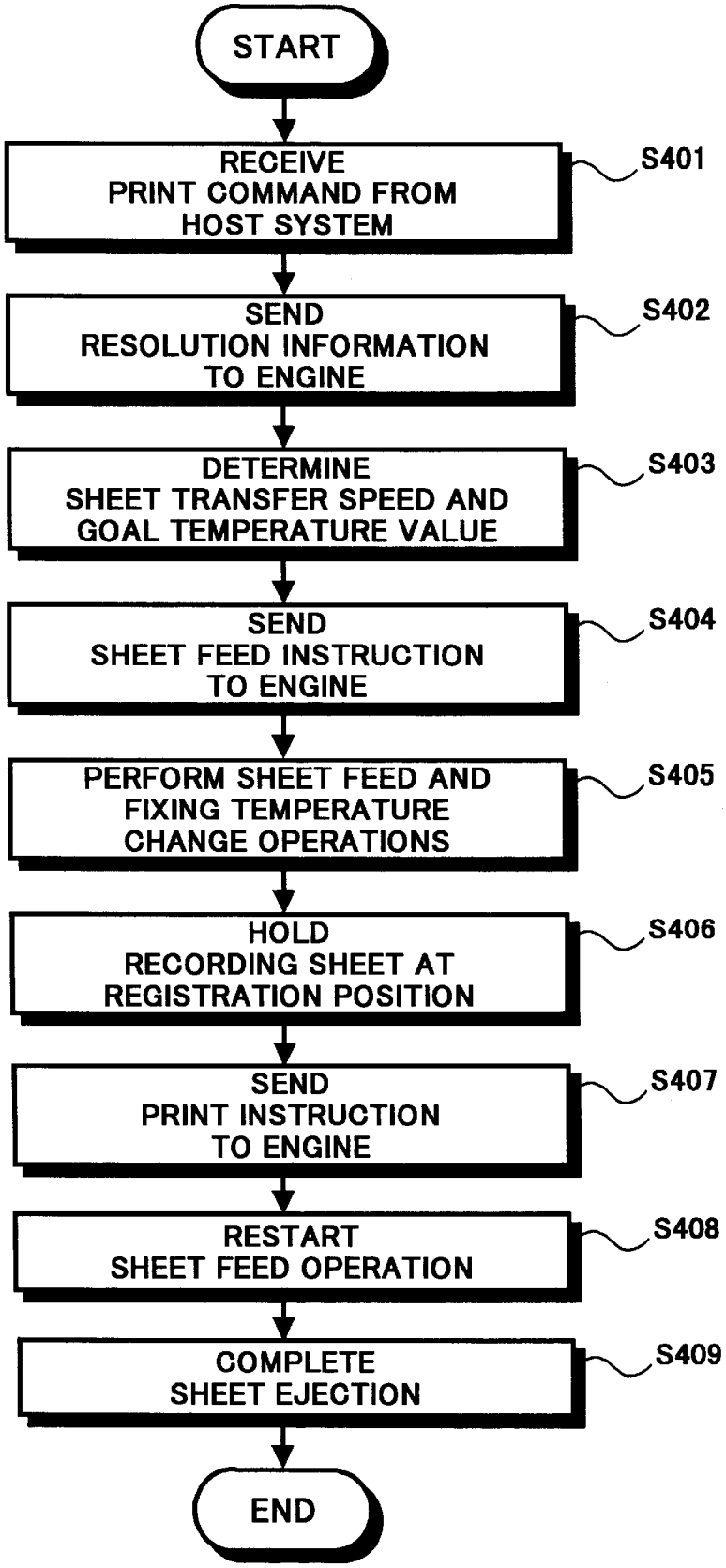
FIG. 12 is a flowchart for explaining a fourth example of an image forming operation performed by the laser printer of FIG. 1.

FIG. 12 shows an outline of a print control performed during the above-mentioned fourth control procedure by the printer controller 21 of the laser printer 1. In Step S401, the printer controller 1 receives a print command from the external host system 50. Upon a receipt of the print command by the laser printer 1, the printer controller 21 provides the CPU 26 of the engine control board 23 with the information of the print resolution requested by the print command in Step S402. In Step S403, the CPU 26 determines a transfer speed of recording sheets and a goal value of the surface temperature of the fixing rollers. In Step S404, the printer controller 21 sends a sheet transfer instruction to the CPU 26. The sheet transfer instruction requests the performance of the sheet transfer operation.

In Step S405, the CPU 26 performs a fixing temperature change operation and instructs the engine 22 to perform the sheet transferring operation. In Step S406, the engine 22 performs the sheet transfer operation and stops the recording sheet at the registration rollers 10. In Step S407, the printer controller 21 sends a print command to the engine 22 via the CPU 26. In Step S408, after a completion of the fixing temperature change operation, the engine 22 allows the recording sheet to restart from the registration rollers. During Step S408, the engine 22 finishes the performance of the sheet transfer operation and the print operation using the transfer speed of recording sheets and the goal value of the surface temperature of the fixing rollers determined by the CPU 26. In Step S409, the engine 22 completes the recording sheet ejection operation for ejecting the printed recording sheet to the eject tray, and the process ends.

Figure 13:
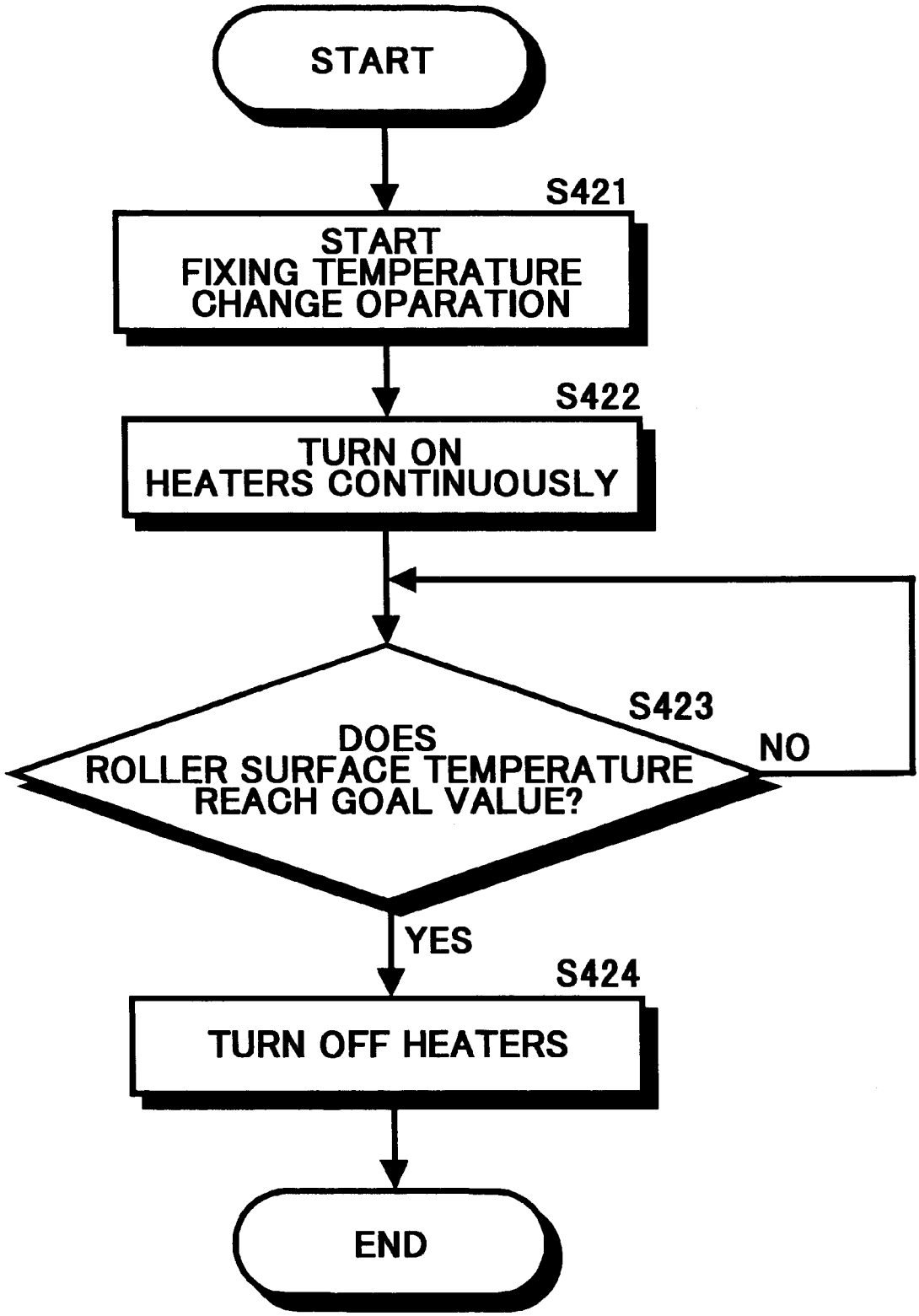
FIG. 13 is a flowchart for explaining a fixing temperature change operation performed in the fourth example by the laser printer of FIG. 1.

FIG. 13 shows another exemplary procedure of the fixing temperature change operation performed during the above-mentioned third control procedure by the CPU 26 and the engine 22. In Step S421, the CPU 26 starts the fixing temperature change operation. In Step S422, the CPU 26 instructs the engine 22 to continuously turn on the heaters 34 and 35. In Step S423, the CPU 26 checks if the temperature information sent from the thermistor 38 reaches the goal surface temperature. If the temperature information sent from the thermistor 38 reaches the goal surface temperature and the check result of Step S423 is YES, the process proceeds to Step S424 and the CPU 26 instructs the engine 22 to turn off the heaters 34 and 35. Then, the process ends.

In this way, the laser printer 1 can stop the recording sheet at the registration rollers waiting for the time when the fixing temperature reaches the goal value during the fixing temperature change operation. Thereby, the laser printer 1 can properly perform the print operation and can produce the first print in a relatively faster manner. Next a fifth control procedure for controlling the fixing temperature in accordance with the variations of the speed at which the recording sheet is transferred in the laser printer 1 is explained with reference to FIGS. 14 and 15. This control is capable of avoiding a problem in which a first print takes a relatively long time period. The reason for the above problem is that the sheet feeding operation is required to be performed after the surface temperature of the fixing roller reaches a newly established goal temperature. This control makes it possible for the user to select either one of speed- and quality-prioritized modes. The speed-prioritized mode is based on the conventional operation and the quality-prioritized mode is based on the above-described first control procedure. The selection can be made by a switch manipulation through the operation panel 24.

Figure 14:
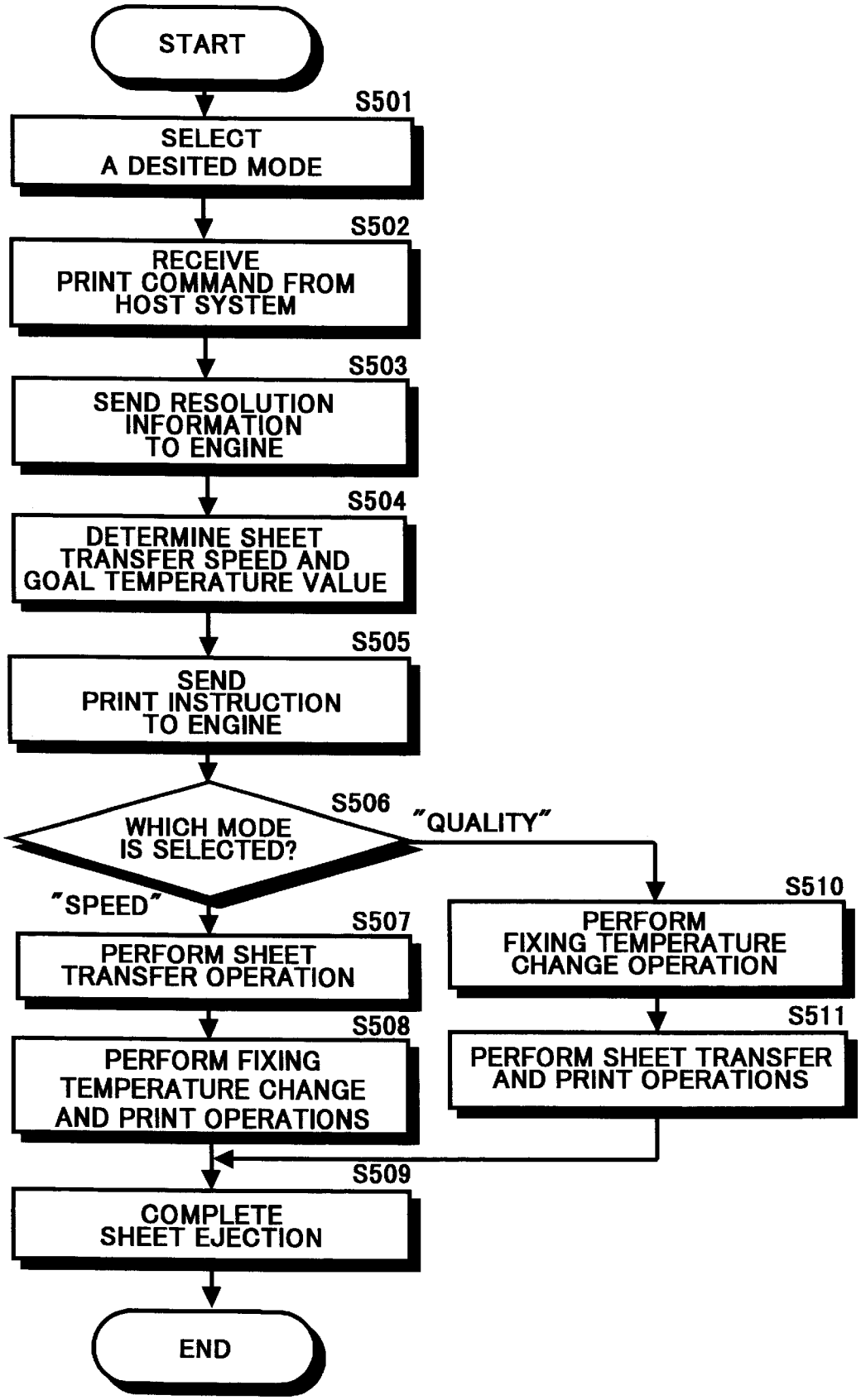
FIG. 14 is a flowchart for explaining a fifth example of an image forming operation performed by the laser printer of FIG. 1.

FIG. 14 shows an outline of a print control performed during the above-mentioned fifth control procedure by the printer controller 21 of the laser printer 1. In Step S501, one of either speed- and quality-prioritized modes is previously selected by the operator through the operation panel 24. In Step S502, the printer controller 1 receives a print command from the external host system 50. Upon a receipt of the print command by the laser printer 1, the printer controller 21 provides the CPU 26 of the engine control board 23 with the information of the print resolution requested by the print command in Step S503. In Step S504, the CPU 26 determines a transfer speed of recording sheets and a goal value of the surface temperature of the fixing rollers. In Step S505, the printer controller 21 sends a sheet transfer instruction and a print instruction to the CPU 26.

In Step S506, the printer controller 21 determines which mode is selected. If the speed-prioritized mode is selected and the determination result of Step S506 is "Speed," the process proceeds to Step S507 and the CPU 26 instructs the engine 22 to start the sheet transfer operation. In Step S508, the CPU 26 performs the fixing temperature change operation and instructs the engine 22 to perform the print operation. Then, in Step S509, the engine 22 ejects the printed recording sheet to the eject tray, and the process ends.

If the quality-prioritized mode is selected and the determination result of Step S506 is "Quality," the process proceeds to Step S510 and the CPU 26 performs the fixing temperature change operation. In Step S511, the CPU 26 instructs the engine 22 to start the sheet transfer operation and instructs the engine 22 to perform the print operation. After that, the process moves to Step S509 and the engine 22 ejects the printed recording sheet to the eject tray. Then, the process ends.

Figure 15:
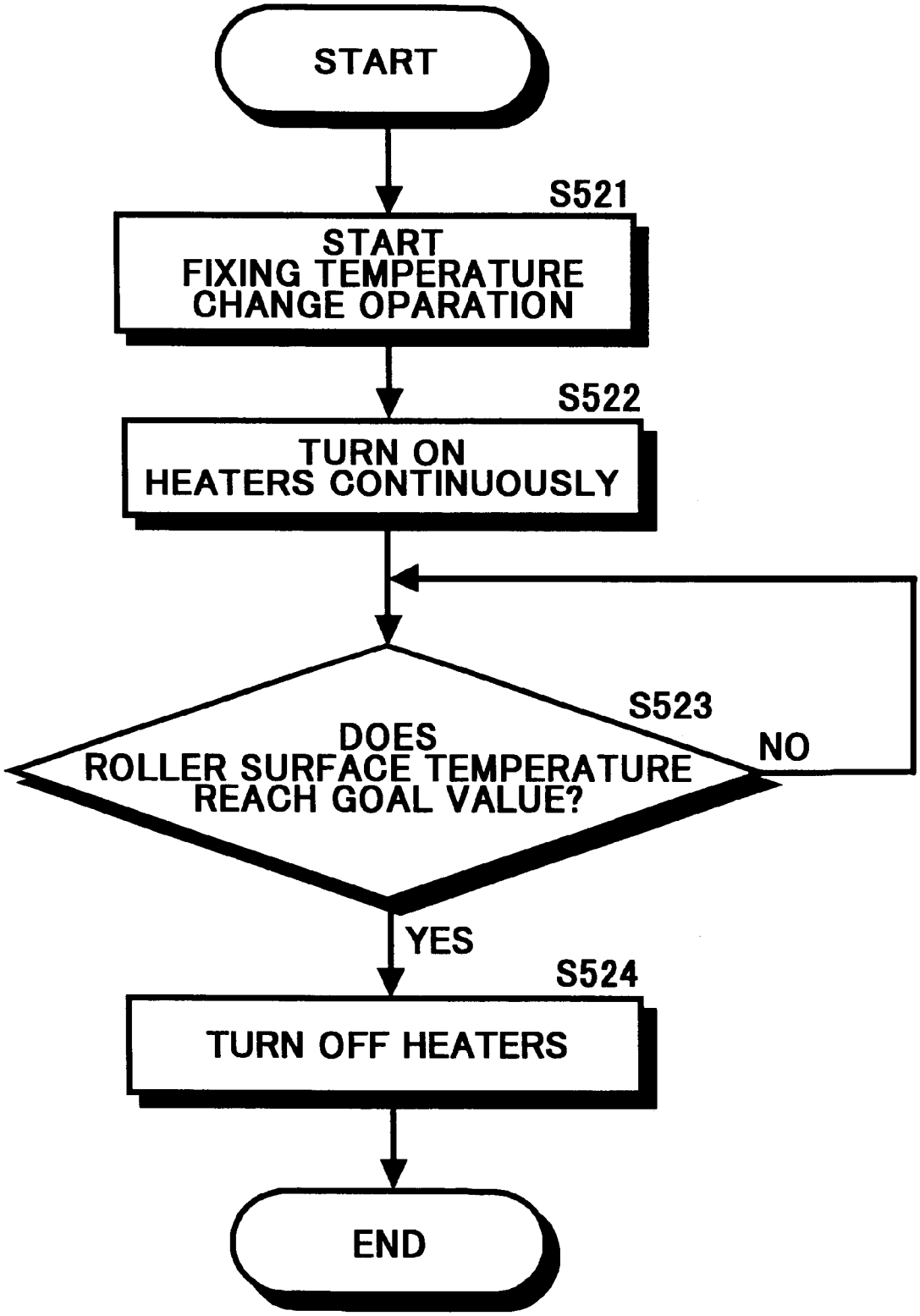
FIG. 15 is a flowchart for explaining a fixing temperature change operation performed in the fifth example by the laser printer of FIG. 1.

The exemplary procedure of the fixing temperature change operation shown in FIG. 15 is similar to that shown in FIG. 9 and, therefore, the description of the procedure is omitted.

In this way, the laser printer 1 can allow the user to select either one of the speed- and quality-prioritized modes by manipulating switches, or a touch-sensing-panel, or the like mounted on the operation panel 24.

Next, a sixth control procedure for controlling the fixing temperature in accordance with the variations of the speed at which the recording sheet is transferred in the laser printer 1 is explained with reference to FIGS. 16 and 17. This control procedure allows users to select either one of the speed- and quality-prioritized modes from the external host system 50, specifically for the case when the laser printer 1 is connected to a local area network and is used as a shared printer by a plurality of users.

FIG. 16 shows an outline of a print control performed during the above-mentioned fourth control procedure by the printer controller 21 of the laser printer 1. The printer controller 1 receives from the external host system 50 a mode select command in Step S601 and a print command successively in Step S602. Upon a receipt of the print command by the laser printer 1, the printer controller 21 provides the CPU 26 of the engine control board 23 with the information of the print resolution requested by the print command in Step S603. In Step S604, the CPU 26 determines a transfer speed of recording sheets and a goal value of the surface temperature of the fixing rollers. In Step S605, the printer controller 21 sends a sheet transfer instruction and a print instruction to the CPU 26.

In Step S606, the printer controller 21 determines which mode is selected. If the speed-prioritized mode is selected and the determination result of Step S606 is "Speed," the process proceeds to Step S607 and the CPU 26 instructs the engine 22 to start the sheet transfer operation. In Step S608, the CPU 26 performs the fixing temperature change operation and instructs the engine 22 to perform the print operation. Then, in Step S609, the engine 22 ejects the printed recording sheet to the eject tray, and the process ends.

If the quality-prioritized mode is selected and the determination result of Step S606 is "Quality," the process proceeds to Step S610 and the CPU 26 performs the fixing temperature change operation. In Step S611, the CPU 26 instructs the engine 22 to start the sheet transfer operation and instructs the engine 22 to perform the print operation. After that, the process moves to Step S609 and the engine 22 ejects the printed recording sheet to the eject tray. Then, the process ends.

Figure 17:
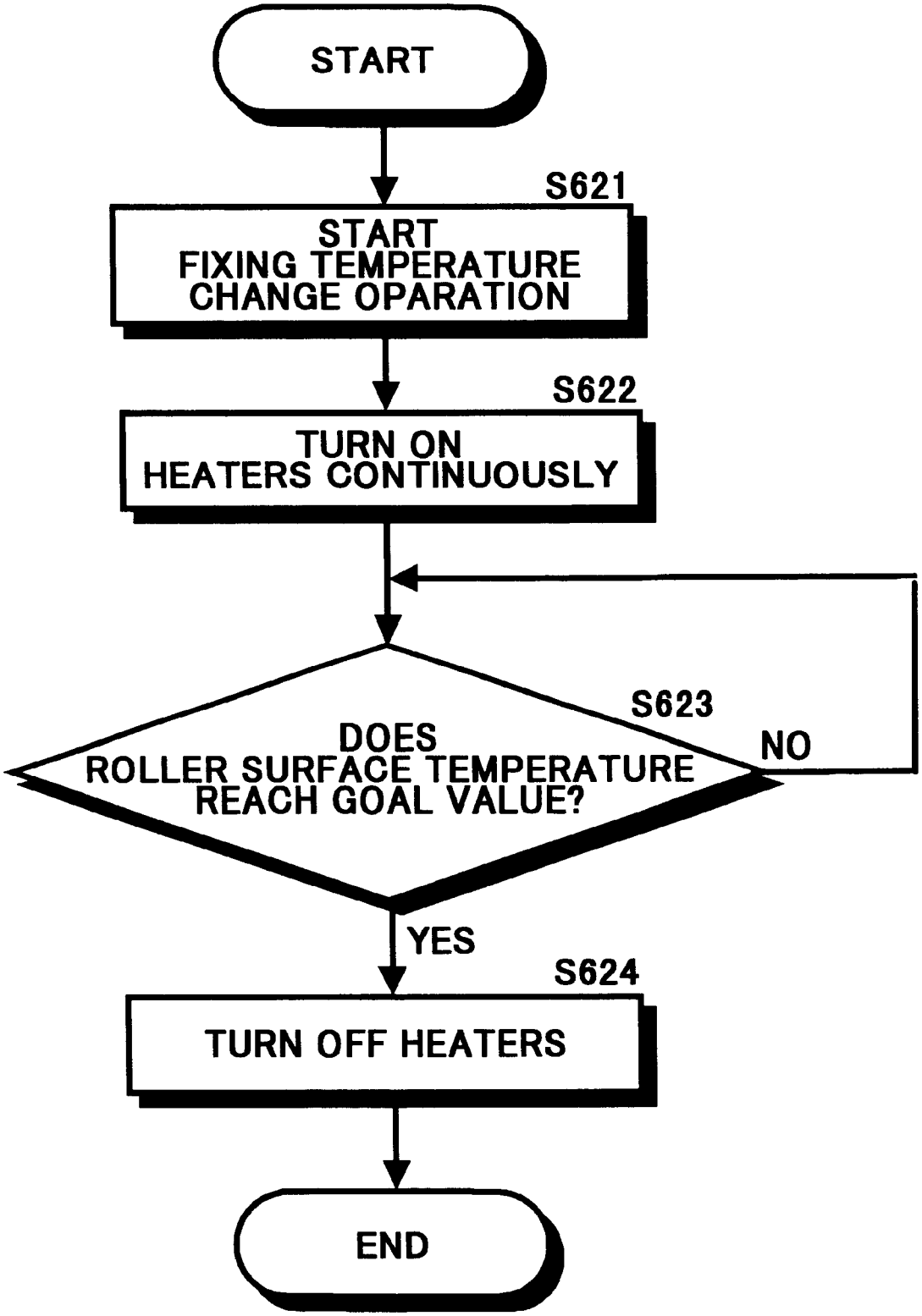
FIG. 17 is a flowchart for explaining a fixing temperature change operation performed in the sixth example by the laser printer of FIG. 1.
Figure 18:
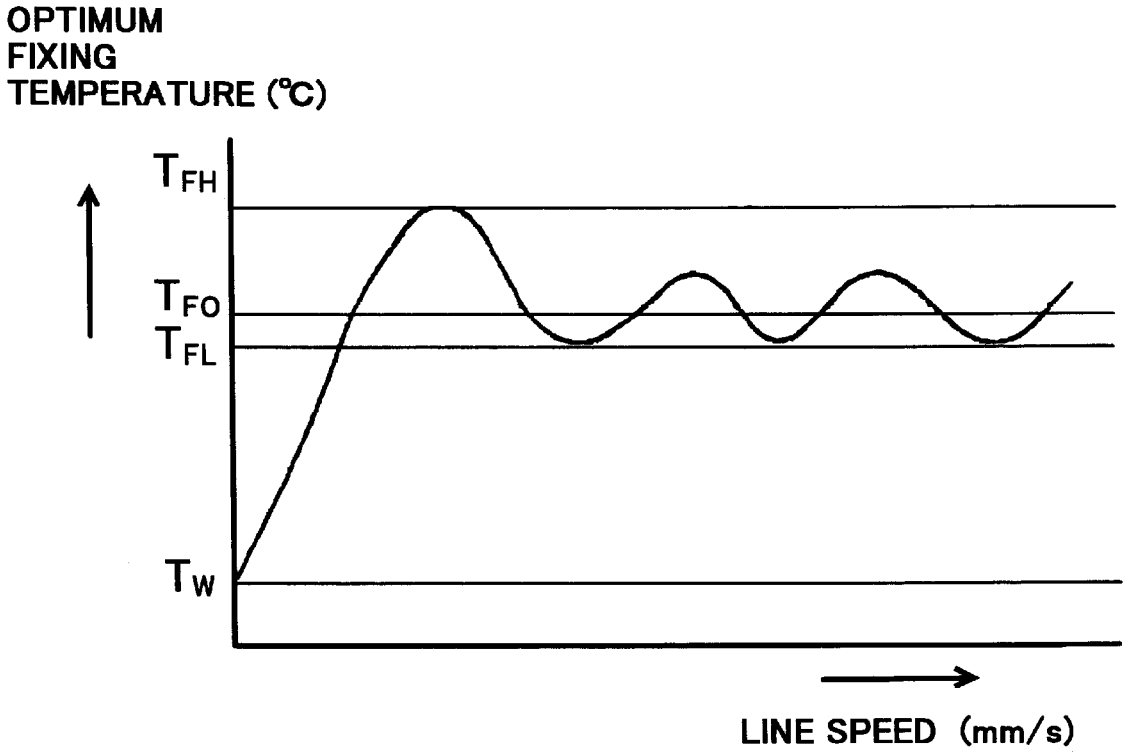
FIG. 18 is a graph for showing a relationship between an optimum fixing temperature and a line speed in a conventional laser printer.

The exemplary procedure of the fixing temperature change operation shown in FIG. 17 is similar to that shown in FIG. 9 and, therefore, the description of the procedure is omitted.

In this way, the laser printer 1 can allow the user to select either one of the speed- and quality-prioritized modes from the external host system 50.

The above-mentioned selection of the speed- and quality-prioritized modes may be applied to the above-described third control procedure.

In general, a reduction of temperature takes a longer time than a case of increasing temperature. For example, when the sheet transfer mode is changed to a lower mode, i.e., when the fixing temperature is changed from 180° C. to 140° C., it takes approximately 2 minutes. But, when the sheet transfer mode is changed to a higher mode, i.e., when the fixing temperature is changed from 140° C. to 180° C., it takes approximately between 30 and 40 seconds. Accordingly, the change of the image resolution from lower to higher (from a greater line speed to a smaller line speed) needs a longer time than that from higher to lower (from a smaller line speed to a greater line speed).

From the above, the laser printer may be provided with selections; in one selection, the speed- and quality-prioritized modes are set for the case in which the sheet transfer speed is changed from faster to slower (from a lower resolution to a higher resolution), and in one selection, the speed- and quality-prioritized modes are set for the case in which the sheet transfer speed is changed from slower to faster (from a higher resolution to a lower resolution). With this selection, users may use the laser printer 1 in the manner more suitable to their desires. For example, when changing the slower line speed to the faster line speed, the user may select the quality-prioritized mode because the change may not take long. On the contrary, when changing the faster line speed to the slower line speed, the user may select the speed-prioritized mode because the change may take long.

In addition, the time difference between the speed- and quality-prioritized modes in the case when the transfer speed is changed from slower to faster is smaller than that in the case when the transfer speed is changed from faster to slower. Accordingly, it may be more practical to provide such a selection of the speed- and quality-prioritized modes only to the case when the transfer speed is changed from slower to faster.

In addition, the image forming apparatus generally accepts various kinds of paper including a thick paper, an ordinary paper, and a thin paper. When the image forming apparatus uses the thin paper in the speed-prioritized mode, it may have a higher risk to cause a wrinkle on the thin paper. Accordingly, it is preferable for the image forming apparatus to perform the quality-prioritized mode in such a case even if it is against the user instruction. In this case, the external host system 50 may need to indicate such performance against the user instruction so as to avoid a misunderstanding in which the user may interpret this phenomenon as a printer malfunction. It may also be possible for the user to forcibly instruct the performance of the speed-prioritized mode after recognizing the indication.

The above-described control procedures may be applied not only to the laser printer having the fixing member of the heat roller but also to printers having the fixing member of a thermal head, a register, a induction heating member, and so forth.

This invention may be conveniently implemented using a conventional general purpose digital computer programmed according to the teaching of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations of the present application are possible in light of the above teachings. It is therefore to be understood that within the scope of the appended claims, the present application may be practiced otherwise than as specifically described herein.

What is claimed as new and is desired to be secured by Letters Patent of the United States is:

1. An image forming apparatus, comprising:

a fixing mechanism, comprising a heater, configured to fix a toner image on a recording sheet at a fixing position;

a power source configured to drive the heater;

a sheet transfer mechanism configured to transfer said recording sheet from a sheet cassette to an eject tray via said fixing position; and a controller to change a sheet transfer speed upon varying an image resolution, to instruct said power source to drive said heater to increase a temperature of said heater up to a goal temperature, to set said goal temperature to a predetermined value when said sheet transfer speed is greater than a predetermined speed, to control said temperature of said heater via said power source by varying said goal temperature in accordance with values of said sheet transfer speed when said sheet transfer speed is smaller than said predetermined speed and to start a sheet transfer operation at a time before said heater reaches said goal temperature so that a recording sheet arrives at said fixing position when a temperature of said heater reaches said goal temperature.

2. The image forming apparatus as defined in claim 1, wherein said controller changes said goal temperature to one of at least three different values.

3. The image forming apparatus as defined in claim 1, wherein said controller sets said goal temperature to a first value when said sheet transfer mechanism transfers said recording sheet at a first speed and to a second value when said sheet transfer mechanism transfers said recording sheet at a second speed, wherein said first value is higher than said second value and said first speed is faster than said second speed, and instructs said sheet transfer mechanism to start a sheet transfer operation when a temperature of said heater reaches said goal temperature changed in accordance with said sheet transfer speed when said controller changes said sheet transfer speed.

4. The image forming apparatus as defined in claim 1, wherein said sheet transfer mechanism comprises a registration member configured to hold and register said recording sheet before entering into said fixing position.

5. An image forming apparatus, comprising:

fixing means for fixing a toner image on a recording sheet at a fixing position;

power source means for driving said fixing means;

sheet transfer means for transferring said recording sheet from a sheet cassette to an eject tray via said fixing position; and controlling means for changing a sheet transfer speed upon varying an image resolution, instructing said power source means to drive said fixing means to increase a temperature of said fixing means up to a goal temperature, setting said goal temperature to a predetermined value when said sheet transfer speed is greater than a predetermined speed, controlling said temperature of said fixing means via said power source by varying said goal temperature in accordance with values of said sheet transfer speed when said sheet transfer speed is smaller than said predetermined speed and instructing said sheet transfer means to start a sheet transfer operation at a time before said fixing means reaches said goal temperature so that a recording sheet arrives at said fixing position when a temperature of said heating means reaches said goal temperature.

6. The image forming apparatus as defined in claim 5, wherein said controlling means changes said goal temperature to one of at least three different values.

7. The image forming apparatus as defined in claim 5, wherein said controlling means sets said goal temperature to a first temperature when said sheet transfer means transfers said recording sheet at a first speed and to a second temperature when said sheet transfer means transfers said recording sheet at a second speed, wherein said first temperature is higher than said second temperature and said first speed is faster than said second speed, and instructs said sheet transfer means to start a sheet transfer operation when a temperature of said heating means reaches said goal temperature changed in accordance with said sheet transfer speed when said controlling means changes said sheet transfer speed.

8. The image forming apparatus as defined in claim 5, wherein said sheet transfer means comprises registration means for holding and registering said recording sheet before entering into said fixing position.

9. A method for image forming, comprising the steps of:

changing a sheet transfer speed for transferring a recording sheet upon varying an image resolution;

setting a goal temperature to a predetermined degree in accordance with values of said sheet transfer speed when said sheet transfer speed is greater than a predetermined value;

controlling a temperature of a heater when said sheet transfer speed is smaller than said predetermined speed;

increasing said temperature of said heater up to said goal temperature;

starting a sheet transfer operation at a time before said heater reaches said goal temperature so that a recording sheet arrives at said fixing position when a temperature of said heater reaches said goal temperature; and fixing a toner image deposited on said recording sheet at said goal temperature.

10. An image forming apparatus, comprising:

a fixing mechanism, comprising a heater, configured to fix a toner image on a recording sheet at a fixing position;

a power source configured to drive the heater;

a sheet transfer mechanism configured to transfer said recording sheet from a sheet cassette to an eject tray via said fixing position;

a controller to change a sheet transfer speed upon varying an image resolution, to instruct said power source to drive said heater to increase a temperature of said heater up to a goal temperature, to set said goal temperature to a predetermined degree when said sheet transfer speed is greater than a predetermined speed, to control said temperature of said heater via said power source by varying said goal temperature in accordance with values of said sheet transfer speed when said sheet transfer speed is smaller than said predetermined speed; and a mode selection mechanism for selecting one of first and second modes, in said first mode said controller instructing said sheet transfer mechanism to start a sheet transfer operation after a temperature of said heater reaches said goal temperature which is changed in accordance with said sheet transfer speed when said controller changes said sheet transfer speed, and in said second mode said controller instructing said sheet transfer mechanism to start a sheet transfer operation before a temperature of said heater reaches said goal temperature which is changed in accordance with said sheet transfer speed when said controller changes said sheet transfer speed.

11. The image forming apparatus as defined in claim 10, wherein in said first mode said controller instructs said sheet transfer mechanism to start said sheet transfer operation at a time so that said recording sheet arrives at said fixing position when said temperature of said heater reaches said goal temperature, and in said second mode said controller instructs said sheet transfer mechanism to start said sheet transfer operation at a time so that said recording sheet arrives at said fixing position before said temperature of said heater reaches said goal temperature.

12. The image forming apparatus as defined in claim 10, wherein said mode selection mechanism selects one of said first and second modes when said sheet transfer speed is changed from said first speed to said second speed.

13. The image forming apparatus as defined in claim 10, wherein said mode selection mechanism independently selects one of said first and second modes when said sheet transfer speed is changed from said first speed to said second speed and when said sheet transfer speed is changed from said second speed to said first speed.

14. The image forming apparatus as defined in claim 10, wherein said mode selection mechanism selects one of said first and second modes based on a command sent from an external host system connected to said apparatus.

15. The image forming apparatus as defined in claim 10, wherein said apparatus handles thick and thin recording sheets and said mode selection mechanism selects said first mode for said thin recording sheet.

16. An image forming apparatus, comprising:

fixing means for fixing a toner image on a recording sheet at a fixing position;

power source means for driving said fixing means;

sheet transfer means for transferring said recording sheet from a sheet cassette to an eject tray via said fixing position; and controlling means for changing a sheet transfer speed by varying an image resolution, instructing said power source means to drive said heating means to increase a temperature of said fixing means up to a goal temperature, setting said goal temperature to a predetermined value when said sheet transfer speed is greater than a predetermined speed, and controlling said temperature of said fixing means via said power source by varying said goal temperature in accordance with values of said sheet transfer speed when said sheet transfer speed is smaller than said predetermined speed, wherein said controlling means sets said goal temperature to a first temperature when said sheet transfer means transfers said recording sheet at a first speed and to a second temperature when said sheet transfer means transfers said recording sheet at a second speed, wherein said first temperature is higher than said second temperature and said first speed is faster than said second speed, and instructs said sheet transfer means to start a sheet transfer operation when a temperature of said heating means reaches said goal temperature changed in accordance with said sheet transfer speed when said controlling means changes said sheet transfer speed; and mode selection means for selecting one of first and second modes, in said first mode said controlling means instructing said sheet transfer means to start a sheet transfer operation after a temperature of said heating means reaches said goal temperature which is changed in accordance with said sheet transfer speed when said controlling means changes said sheet transfer speed, and in said second mode said controlling means instructing said sheet transfer means to start a sheet transfer operation before a temperature of said heating means reaches said goal temperature which is changed in accordance with said sheet transfer speed when said controlling means changes said sheet transfer speed.

17. The image forming apparatus as defined in claim 16, wherein in said first mode said controlling means instructs said sheet transfer means to start said sheet transfer operation at a time so that said recording sheet arrives at said fixing position when said temperature of said heating means reaches said goal temperature, and in said second mode said controlling means instructs said sheet transfer means to start said sheet transfer operation at a time so that said recording sheet arrives at said fixing position before said temperature of said heating means reaches said goal temperature.

18. The image forming apparatus as defined in claim 16, wherein said mode selection means selects one of said first and second modes when said sheet transfer speed is changed from said first speed to said second speed.

19. The image forming apparatus as defined in claim 16, wherein said mode selection means independently selects one of said first and second modes when said sheet transfer speed is changed from said first speed to said second speed and when said sheet transfer speed is changed from said second speed to said first speed.

20. The image forming apparatus as defined in claim 16, wherein said mode selection means selects one of said first and second modes based on a command sent from an external host system connected to said apparatus.

21. The image forming apparatus as defined in claim 16, wherein said apparatus handles thick and thin recording sheets and said mode selection means selects said first mode for said thin recording sheet.

* * * * *